United States Patent [19]

Kanetake et al.

[11] Patent Number: 4,977,071

[45] Date of Patent: Dec. 11, 1990

[54] SILVER HALIDE PHOTOGRAPHIC MATERIAL CONTAINING AN INTERLAYER CONTAINING A COPOLYMER CORE-SHELL LATEX

[75] Inventors: Satoshi Kanetake; Shinichi Hashimoto; Shigetoshi Ono; Takashi Naoi, all of Kanagawa, Japan

[73] Assignee: Fuji Photo Film Co., Ltd., Kanagawa, Japan

[21] Appl. No.: 356,161

[22] Filed: May 24, 1989

[30] Foreign Application Priority Data

| | | | |
|---|---|---|---|
| May 24, 1988 | [JP] | Japan | 63-126545 |
| Jul. 13, 1988 | [JP] | Japan | 63-174698 |
| Jul. 13, 1988 | [JP] | Japan | 63-174699 |

[51] Int. Cl.[5] ..... G03C 1/76

[52] U.S. Cl. ..... 430/534; 430/533; 430/535; 430/536; 430/537; 430/627

[58] Field of Search ..... 430/534, 627, 533, 535, 430/536, 537

[56] References Cited

U.S. PATENT DOCUMENTS

| | | | |
|---|---|---|---|
| 4,213,783 | 7/1980 | Cook | 430/533 |
| 4,495,273 | 1/1985 | Pannochia et al. | 430/534 |
| 4,645,731 | 2/1987 | Bayless et al. | 430/533 |
| 4,714,671 | 12/1987 | Helling et al. | 430/627 |

*Primary Examiner*—Jack P. Brammer

*Attorney, Agent, or Firm*—Sughrue, Mion, Zinn, Macpeak & Seas

[57] ABSTRACT

A silver halide photographic material composed of a polyester film support having thereon at least one hhydrophilic colloid layer containing a polymer latex; and between the support and the hydrophilic colloid layer a layer containing a vinylidene chloride copolymer core-shell latex; at least one hydrophilic colloid layer of the material being a light-sensitive silver halide emulsion layer. The photographic material has superior dimensional stability after processing.

18 Claims, No Drawings

SILVER HALIDE PHOTOGRAPHIC MATERIAL CONTAINING AN INTERLAYER CONTAINING A COPOLYMER CORE-SHELL LATEX

FIELD OF THE INVENTION

This invention relates to a silver halide photographic material having excellent dimensional stability. It also relates to a silver halide photographic material having improved uniformity in film thickness and improved physical properties with respect to its film properties and particularly improved adhesion to binders.

BACKGROUND OF THE INVENTION

Generally, silver halide photographic materials have a layer containing a hydrophilic colloid, such as gelatin, as a binder on at least one side of a support. The hydrophilic colloid layer has the disadvantage that it is liable to be expanded or contracted by changes in humidity and temperature.

The dimensional change of the photographic materials due to the expansion and contraction of the hydrophilic colloid layer is a very serious problem in the field of printing photographic materials which must reproduce accurately line drawings or halftone dot images for multi-color printing U.S. Pat. No. 3,201,250 discloses a method wherein the ratio of the hydrophilic colloid layer to the support is specified for photographic materials that have excellent dimensional stability. The incorporation of a polymer latex in the hydrophilic colloid layer is described in Nos. JP-B-39-4272 (the term "JP-B" as used herein means an "examined Japanese patent puplication), JP-B-39-17702, JP-B-43-13482, JP-B-45-5331, U.S. Pat. Nos. 237,600, 2,763,625, 2,772,166, 2,852,386, 2,853,457, 3,397,988, 3,411,911 and 3,411,912. The techniques described in the specifications of these patents are based on the description of J. Q. Umberger, et al., *Photo. Sci. and Eng.*, pages 69 to 73 (1957).

The problem of change in the dimension of the silver halide photographic materials caused by change of humidity and temperature can be improved by the above techniques.

However, change in the dimension of the silver halide photographic materials caused by the development thereof cannot be prevented by these techniques. The phenomenon of the change in the dimension of the materials caused by development is a serious problem in the use of the photographic materials, because the dimension of the photographic materials during exposure are different from those after development.

A method using a vinyl chloride undercoat is disclosed in Japanese Patent Application No. 62-94133 to improve dimensional stability during development. However, the problem of dimensional change caused by development cannot be satisfactorily solved by this method, and a method for solving the problem is required.

When the polymer latex is incorporated in the hydrophilic colloid layer as described above, the polymer latex often has an adverse effect on film strength, wear resistance and the adhesion of the layer to the support in developing solutions.

Methods for solving the problem of the adverse effect of the polymer latex by using polymers having an active methylene group capable of reacting with conventional gelatin hardening agents are disclosed in U.S. Pat. Nos. 3,459,790, 3,488,708, 3,554,987, 3,700,456 and 3,939,130, U.K. Patent No. 1,491,701. Dimensional stability in the developing solutions could be somewhat improved by these methods without detriment to film strength and wear resistance. However, a further improvement in dimensional stability is highly demanded in the field of multi-color printing or printing which must reproduce accurate line drawings. No. JP-A-60-3627 (the term "JP-A" as used herein means an "unexamined published Japanese patent application") discloses a method for improving dimensional stability by using a support prepared by coating both sides of a polyester film with a polyolefin. However, this method is of no practical use.

As methods for obtaining high-contrast photographic properties, methods using hydrazine derivatives are disclosed in U.S. Pat. Nos. 4,224,401, 4,168,977, 4,166,742, 4,311,781, 4,272,606, 4,211,857 and 4,243,739.

According to these methods, there can be obtained photographic materials having super-high contrast and high sensitivity. However, when a large amount of the polymer latex is used for the purpose of improving dimensional stability, it has an adverse effect on photographic characteristics. For example, the function of the hydrazine derivatives to obtain high contrast is inhibited and as a result, high contrast photographic characteristics cannot be obtained Thus, there is the disadvantage hat the amount of the polymer latex to be used is limited and hence satisfactory dimensional stability cannot be obtained The ratio of the expansion of unprocessed films and processed films due to change in humidity can be reduced by specifying the ratio of the thickness of the hydrophilic colloid layer to that of the support. However, the dimensional stability of photographic films before and after processing stages (e.g., development fixing, water washing, drying) cannot be improved, because the support is elongated by water absorption during these processing stages and not restored to its original state after drying and it takes a long time until it is restored to its original form. Hence, the support in practice remains elongated. When the length of the unprocessed film is compared with that of the processed film, the latter often remains elongated. Accordingly, dimensional stability is deteriorated by processing including development and this is a serious problem in the field of printing photographic materials.

Though the ratio of the expansion of the film due to the change of humidity can be reduced by incorporating the polymer latex in the hydrophilic colloid layer, the above-described problem cannot be solved, because processing solutions penetrate into the support during the processing stages.

Japanese Patent Application No. 62-94133 discloses polyester supports coated with vinylidene chloride copolymers to solve the above-described problem. This technique is a excellent to improve the change of dimensional stability caused by the processing of the printing photographic materials. However when the support is coated with the vinylidene chloride copolymer, a coated film having a uniform thickness can scarcely be obtained There are problems that the coating is uneven and adhesion between the support and binders becomes poor. An effective method for solving the problems has not been found.

Further, when the vinylidene chloride copolymer is coated, a high shearing force is often applied to a gap between a coated surface and a coater or to the backflow valves of feed pumps for feeding coating solutions.

Thus, there are problems that the polymer is agglomerated, the coated surface is deteriorated and production units must be cleaned.

SUMMARY OF THE INVENTION

A first object of the present invention is to provide a silver halide photographic material having excellent dimensional stability against environmental change and processing.

A second object of the present invention is to provide a silver halide photographic material which is a high-contrast material obtained by using hydrazine derivatives and has excellent dimensional stability against environmental change and processing.

A third object of the present invention is to provide a silver halide photographic material which is excellent in film strength, wear resistance and adhesion between the support and the binder in the developing solutions and has excellent dimensional stability against environmental change and processing.

A fourth object of the present invention is to provide a silver halide photographic material in which the polyester film support is firmly bonded to the hydrophilic colloid layer.

A fifth object of the present invention is to provide a silver halide photographic material in which the vinylidene chloride copolymer coat has a uniform thickness and the surface thereof is smooth and which has excellent adhesion between the support and the binder and excellent dimensional stability against environmental change and processing.

It has how been found that these and other objects of the present invention are achieved by a silver halide photographic material composed of a polyester film support having thereon at least one hydrophilic colloid layer containing a polymer latex; and between the support and the hydrophilic colloid layer a layer containing a vinylidene chloride copolymer coreshell latex; at least one hydrophilic colloid layer of the material being a light-sensitive silver halide emulsion layer. The present invention includes a silver halide photographic material having comprising at least one hydrophilic colloid layer containing a polymer latex provided on a polyester film support, in which the polyester film support is coated with a layer of a vinylidene chloride copolymer composed of a core-shell type latex wherein the core of the core-shell type latex contains at least one repeating unit represented by formula (I) and at least one repeating unit represented by formula (II), and the shell thereof contains at least one repeating unit represented by formula (I), at least one repeating unit represented by formula (III) and at least one repeating unit represented by formula (IV):

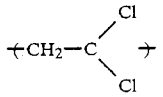
(I)

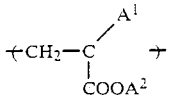
(II)

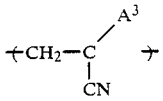
(III)

-continued

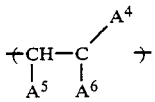
(IV)

wherein $A^1$ represents hydrogen, methyl or a halogen atom; $A^2$ represents a substituted or unsubstituted alkyl group or phenyl group; $A^3$ represents hydrogen or methyl; $A^4$ represents hydrogen, methyl or $—CH_2$-COOM; $A^5$ represents hydrogen, methyl or —COOM; $A^6$ represents —COOM or a COOM-substituted alkoxycarbonyl group, a COOM-substituted phenyl group or a COOM-substituted N-alkylcarbamoyl group; and M represents hydrogen or an alkali metal.

Still further, the present invention includes a method for producing a silver halide photographic material composed of a polyester support having thereon at least one hydrophilic colloid layer containing a polymer latex; and between the support and the hydrophilic colloid layer a layer containing a vinylidene chloride copolymer coreshell latex; at least one hydrophilic colloid layer of the material being a light-sensitive silver halide emulsion layer by the steps of (a) coating a hydrophilic colloid layer on a polyester support; and (b) drying the hydrophilic colloid layer such that the water content of the layer is reduced to at most 8 wt % of the amount, on a dry basis, of the binder contained in the entire layer on the support within 100 seconds, drying being conducted at a temperature of at most 35° C. and a relative humidity of at most 50% during the period during which at most 300 wt % of water based on the amount, on a dry basis, of the binder contained in the whole of the layers is removed.

DETAILED DESCRIPTION OF THE INVENTION

The vinylidene chloride copolymer layer is provided by coating the polyester support with a core-shell type vinylidene chloride copolymer latex.

The vinylidene chloride copolymer latex of the present invention has a vinylidene chloride content of 0.0 to 98.5 wt %, preferably 85 to 97 wt %, more preferably 88 to 94 wt %.

The thickness of the vinylidene chloride copolymer layer is preferably about 0.3 μm or less.

One or more comonomers can be used. Examples of the comonomers include acrylic acid, acrylic esters, methacrylic acid, methacrylic esters, crotonic acid, crotonic esters, vinyl esters, maleic acid and diesters thereof, fumaric acid and diesters thereof, itaconic acid and diesters thereof, acrylamides, methacrylamides, vinyl ethers, styrenes and alkali metal salts (e.g., Na, K) of these acids and ammonium ion salts thereof. Examples of the acrylic esters include methyl acrylate, ethyl acrylate, n-propyl acrylate, isopropyl acrylate, n-butyl acrylate, 3-acryloylpropanesulfonic acid, acetoxyethyl acrylate, phenyl acrylate, 2-methoxyacrylate, 2-ethoxyacrylate, 2-(2-methoxyethoxy)ethyl acrylate and 2-methane sulfonamidoethyl acrylate. Examples of the methacrylic esters include methyl methacrylate, ethyl methacrylate, n-propyl methacrylate, n-butyl methacrylate, tert-butyl methacrylate, cyclohexyl methacrylate, 2-hydroxyethyl methacrylate, 2-ethoxyethyl methacrylate and dimethylethylamino methacrylate. Examples of the crotonic esters include butyl crononate and hexyl crotonate. Examples of vinyl esters include vinyl acetate, vinyl propionate, vinyl butyrate, vinylmethoxy acetate and vinyl benzoate Examples of the maleic diesters include diethyl maleate dimethyl maleate and dibutyl maleate. Examples of the fumaric diesters include diethyl fumarate, dimethyl fumarate and dibutyl fumarate Examples of the itaconic diesters include diethyl itaconate, dimethyl itaconate and dibutyl itaconate. Examples of the acrylamides include acrylamide, methyl acrylamide, ethyl acrylamide, isopropyl acrylamide, n-butyl acrylamide, hydroxymethyl acrylamide, diacetone acrylamide, acryloylmorpholine and acrylamido-2-metylpropanesulfonic acid. Examples of the methacrylamines include methyl methacrylamide, ethyl methacrylamide, n-butyl methacrylamide, tert-butyl methacrylamide, 2-methoxyethyl methacrylamide, dimethyl methacrylamide and diethyl methacrylamide Examples of the vinyl ethers include methyl vinyl ether, butyl vinyl ether, hexyl vinyl ether, methoxyethyl vinyl ether and dimethylaminoethl vinyl ether. Examples of the styrenes include styrene, methylstyrene, dimethylstyrene, trimethylsthyrene, ethylstyrene, isopropylstyrene, butylstyrene, chloromethylstyrene, methoxystyrene, butoxystyrene, acetoxystyrene, chlorostyrene, dichlorostyrene, bromostyrene, methyl vinylbenzoate 2-methylstyrene, styrenesulfonic acid, vinyl benzoate and trimethylaminomethylstyrene.

Examples of other monomers include allyl compounds (e.g., allyl acetate), vinyl ketones (e.g., methyl vinyl ketone), heterocyclic vinyl compounds (e.g., vinylpyridine) and unsaturated nitriles (e.g., acrylonitrile, methacrylonitrile)

Monomers having groups capable of linking to the binders directly or through curing agents may be used. Examples of these groups include on active methylene group, (poly)hydroxyphenyl group, sulfino group, amino group (which may be optionally substituted with an alkyl group or phenyl group), active ester group, active halogen atom, active vinyl group and precursors thereof, epoxy group and ethyleneimine group.

Examples of suitable comonomers include the following compounds, but the present invention is not to be construed as being limited thereto.

I-1

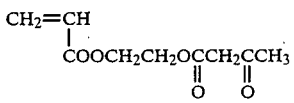

I-2

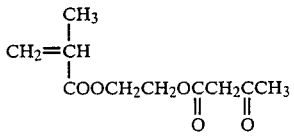

I-3

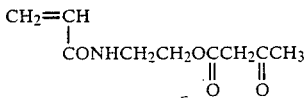

I-4

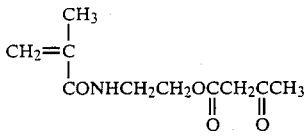

-continued

I-5

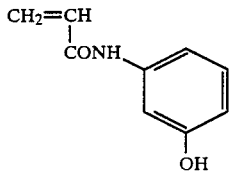

I-6

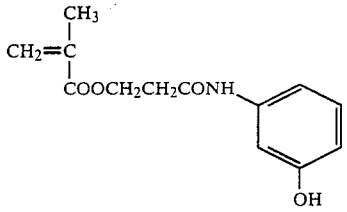

I-7

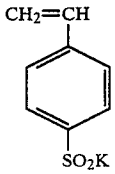

I-8

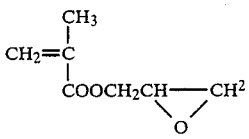

I-9

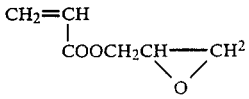

I-10

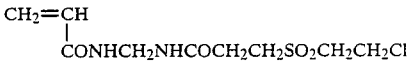

I-11

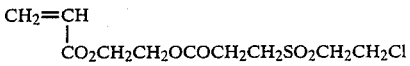

I-12

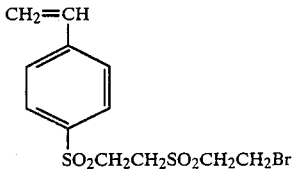

I-13

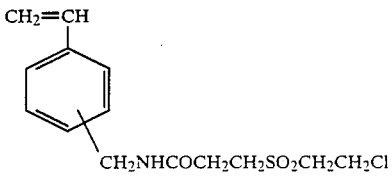

I-14

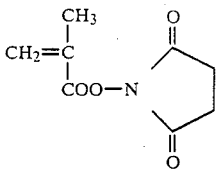

-continued

I-15

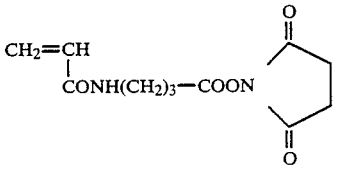

I-16

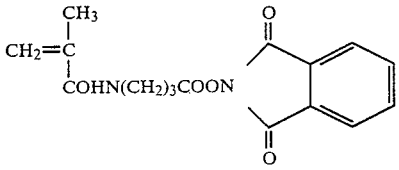

I-17

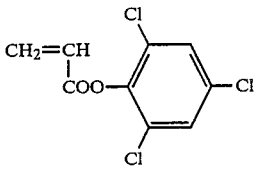

I-18

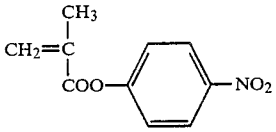

I-19

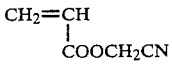

I-20

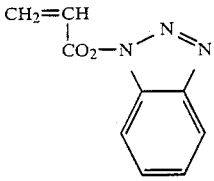

I-21

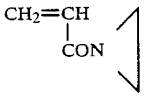

I-22

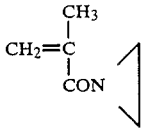

I-23

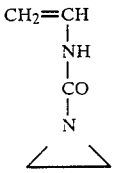

I-24

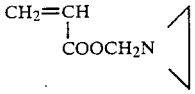

-continued

I-25

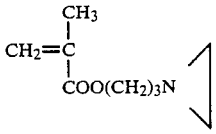

I-26

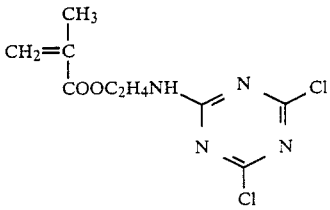

I-27

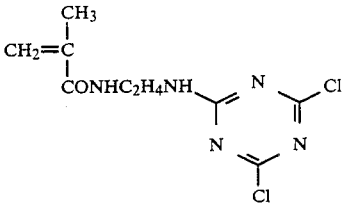

I-28

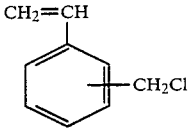

I-29

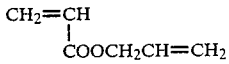

The grain of the vinylidene chloride copolymer latex of the present invention has preferably a size of from about 110 to 150 nm.

The coating amount of the vinylidene chloride copolymer latex layer is preferably about 0.5 g/m$^2$ or more, more preferably from about 0.83 g/m$^2$ to about 3.3 g/m$^2$, and most preferably from about 1.16 g/m$^2$ to about 1.98 g/m$^2$. The thickness of the latex layer is preferably about 0.3 $\mu$m or more.

It is preferred that a core-shell type latex composed of a core having a high vinylidene chloride content is used to improve dimensional stability, when one comonomer is used. The latex composed of a core having a vinylidene chloride content of 88 to 97 wt % and a shell having a vinylidene chloride content of 70 to 92 wt % is particularly preferred. The total ratio of copolymer core/snell of from 7/3 to 95/5 by weight is particularly preferred.

Any of the monomers can be used for the core and the shell, when two or more comonomers are used. However, it is preferred that either more hydrophilic comonomers are used for the shell as compared with the comonomers for the core, or comonomers having groups capable of linking to the binders directly or through the curing agents are used for the shell. It is preferred that the core copolymer has a vinylidene chloride content of 88 to 94 wt % and the shell copolymer has a vinylidene chloride content of 85 to 92 wt %. The ratio of core/shell of from 7/3 to 95/5 by weight is particularly preferred.

The vinylidene chloride copolymer of the present invention can be prepared by emulsion polymerization method described in, for example, U.S. Pat. Nos.

4,350,622, 4,401,788, 4,446,273, 4,535,120, Nos. JP-A-61-108650, 4,350,622, 4,401,788, 4,446,273, 4,535,120, JP-A 61JP-A-62-256871, JP-A-62-246913, JP-A-62-246912, JP-A-57-139136, JP-A-61-236669 and JP-A-57-137109. The present invention has been achieved by using a vinylidene chloride copolymer latex obtained according to these synthesis methods (e.g., synthesis method described in No. JP-A-62-256871).

Any of anionic emulsifying agents, nonionic emulsifying agents, cationic emulsifying agents, betaines, high-molecular surfactants and mixtures thereof can be used as emulsifying agents for the synthesis in the present invention. Among them, anionic emulsifying agents are preferred. Among the anionic emulsifying agents, those containing at least one alkylbenzenesulfonate are particularly preferred. For example, the core moiety of the vinylidene chloride copolymer of the present invention is prepared preferably from a combination of vinylidene chloride with at least one of the monomers of formula (II), at least one of the monomers of the formula (III), at least one of the monomers of the formula (IV) and optionally other monomers.

It is preferred that the core portion of the vinylidene chloride copolymer latex of the present invention accounts for 60 to 95 wt %, particularly 70 to 90 wt % of the whole amount of latex particles and the shell moiety accounts for 5 to 40 wt %, particularly 10 to 30 wt %, of the whole amount of the latex particles.

The ratio (w) of the repeating unit of the formula (I) is 70 to 98.5 wt %, preferably 85 to 97 wt %, most preferably 88 to 94 wt % based on the total amount of the latex particles.

The ratio (x) of the repeating unit of the formula (II) is 1.0 to 20 wt %, preferably 2 to 12 wt %, most preferably 5 to 10 wt %.

The ratio (y) of the repeating unit of the formula (III) is 0.1 to 5.0 wt %, preferably 0.3 to 3.5 wt %, most preferably 0.5 to 2.5 wt %.

The ratio (z) of the repeating unit of the formula (IV) is 0.05 to 3.0 wt %, preferably 0.1 to 1.5 wt %, most preferably 0.1 to 0.8 wt %.

Based on the total amount of the core portion the ratio(w) of the repeating unit of the formula (I) is preferably from about 70 to about 98.5 wt %, more preferably from about 85 to about 97 wt % and most preferably from about 88 to about 94 wt %. The ratio (x) of the repeating unit of the formula (II) is preferably from about 1 to about 30 wt %, more preferably from about 3 to about 20 wt % and most preferably from about 5 to about 12 wt % based on the total amount of the core portion.

Based on the total amount of the shell portion, the ratio (w) of the repeating unit of the formula (I) is preferably from about 70 to about 98.5 wt %, more preferably from about 85 to 97 wt %, more preferably from about 85 to 97 wt % and most preferably from about 88 to about 94 wt %. The ratio (y) of the repeating unit of the formula (III) is preferably from about 0.5 to about 20 wt %, more preferably from about 1 to about 15 wt % and more preferably from about 2 to about 10 wt % based on the total amount of the shell portion The ratio (z) of the repeating unit of the formula (IV) is preferably from about 0.1 to about 6 wt %, more preferably from about 0.2 to about 5 wt % and most preferably from about 0.3 to about 3 wt % based on the total amount of the shell portion.

In the formulas (II) to (IV), $A^1$ is preferably hydrogen, methyl, Cl, F, and more preferably is hydrogen or methyl. $A^2$ is preferably a substituted or unsubstituted alkyl group having from 1 to 6 carbon atoms, more preferably an unsubstituted alkyl group having from 1 to 4 carbon atoms. $A^3$ is hydrogen or methyl. $A^4$ is preferably hydrogen, methyl or $-CH_2COOH$, more preferably hydrogen or methyl. $A^5$ is preferably hydrogen. $A^6$ is preferably —COOH; an alkoxycarbonyl group substituted with —COOH or an N-alkylcarbamoyl group substituted with —COOH and is particularly preferably —COOH.

Examples of substituent groups for the substituted alkyl group represented by $A^2$ and $A^6$, the substituted alkoxy group and phenyl group include an alkoxy group (which may be further substituted with one or more alkoxy group), a halogen atom, nitro group, cyano group, alkyl group (in the case of phenyl group), carbonamido group, carbamoyl group, sulfonamido group, sulfamoyl group and sulfo group.

Examples of the monomers represented by the formulas (II) to (IV) include, the following compounds, but the present invention is not to be construed as being limited thereto.

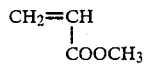
II-1

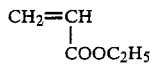
II-2

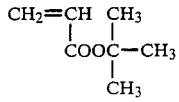
II-3

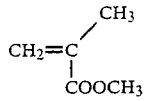
II-4

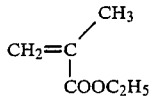
II-5

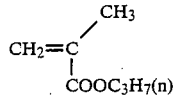
II-6

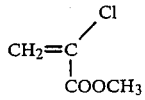
II-7

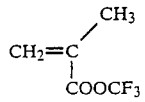
II-8

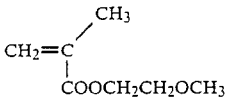
II-9

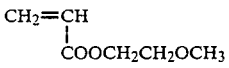
II-10

-continued

III-1 $CH{=}CH(CN)$

III-2 $CH_2{=}C(CN){-}CH_3$

IV-1 $CH_2{=}CH(COOH)$

IV-2 $CH_2{=}C(CH_3)(COOH)$

IV-3 $CH(COOH){=}CH(COOH)$ (Cis or trans)

IV-4 $CH_2{=}C(CH_2COOH)(COOH)$

IV-5 $CH_2{=}C(CH_3)(CONHCH_2CH_2COOH)$

IV-6 $CH_2{=}CH(COOCH_2CH_2OOCCH_2CH_2COOH)$

IV-7 $CH(CH_3){=}CH(COOH)$

Other examples of the monomers represented by formula (II) include n-propyl acrylate, isopropyl acrylate, n-butyl acrylate, 3-acryloylpropanesulfonic acid, acetoxyethyl acrylate, phenyl acrylate, 2-methoxyacrylate, 2-ethoxyacrylate, 2-(methoxyethoxy)ethyl acrylate, 2-methanesulfonamidoethyl acrylate, n-butyl methacrylate, tert-butyl methacrylate, cyclohexyl methacrylate, 2-hydroxyethyl methacrylate, 2-ethoxyethyl methacrylate and dimethylethylamino methacrylate.

Examples of monomers which may be optionally used for the core moiety include crotonic esters, vinyl esters, maleic diesters, fumaric diesters, itaconic diesters, acrylamides, methacrylamides, vinyl ethers and styrenes.

If desired, the monomers represented by formulas (III) and (IV) may be used for the core moiety and the monomers represented by formula (II) may be used for the shell moiety.

Examples of comonomers which may be optionally used for the core moiety include crotonic esters such as butyl crotonate and hexyl crotonate; vinyl esters such as vinyl acetate, vinyl propionate, vinyl butyrate, vinylmethoxy acetate and vinyl benzoate; maleic diesters such as diethyl maleate, dimethyl maleate and dibutyl maleate; fumaric diesters such as diethyl fumarate, dimethyl fumarate and dibutyl fumarate; itaconic diesters such as diethyl itaconate, dimethyl itaconate and dibutyl itaconate; acrylamides such as acrylamide, methyl acrylamide, ethyl acrylamide, isopropyl acrylamide, n-butyl acrylamide, hydroxymethyl acrylamide, diacetone acrylamide, acryloylmorpholine and acrylamido-2-methylpropanesulfonic acid; methacrylamides such as methyl methacrylamide, ethyl methacrylamide, n-butyl methacrylamide, tert-butyl methacrylamide, 2-methoxyethyl methacrylamide, dimethyl methacrylamide and diethyl methacrylamide; vinyl ethers such as methyl vinyl ether, butyl vinyl ether, hexyl vinyl ether, methoxyethyl vinyl ether and dimethylaminoethyl vinyl ether; and styrenes such as styrene, methylstyrene, dimethylstyrene, trimethylstyrene, ethylstyrene, isopropylstyrene, butylstyrene, chloromethylstyrene, methoxystyrene, butoxystyrene, acetoxystyrene, chlorostyrene, dichlorostyrene, bromostyrene, methyl vinylbenzoate 2-methylstyrene, styrenesulfonic acid, vinylbenzoic acid and trimethylaminomethylstyrene.

Examples of other monomers include allyl compounds (e.g., allyl acetate), vinyl ketones (e.g., methyl vinyl ketone), heterocyclic vinyl compounds (e.g., vinylpyridine) and unsaturated nitriles (e.g., acrylonitrile, methacrylnitrile).

Monomers having groups capable of linking to binders directly or through curing agents, may be used. Examples of the groups include active methylene group, (poly)hydroxyphenyl group, sulfino group, amino group (which may be substituted with an alkyl group or phenyl group), active ester group, active halogen atom, active vinyl group and precursors thereof, epoxy group and ethyleneimine group.

The present invention has been achieved by using vinylidene chloride copolymer latexes wherein the shell moiety is composed of a polymer excellent in bonding or shearing stability and the core moiety is composed of a polymer for securing barrier properties The polymer having excellent bonding is obtained by using at least one member of the monomers of the formula (I), at least one member of the monomers of the formula (III) and at least one member of the monomers of the formula (IV). The polymer for securing barrier properties is obtained by using at least one member of the monomers of the formula (I) and at least one member of the monomers of the formula (II)

In the synthesis of the compounds of the present invention, anionic emulsifying agents containing at least one alkylbenzene sulfonate are preferred. For example, these include

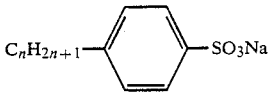

Wherein n is a positive integer and on the average, from about 11 to 16), a mixture of

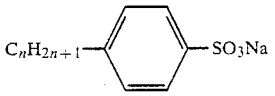

and $C_nH_{2n+1}SO_3Na$ or a mixture of

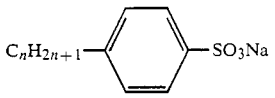

and $C_mH_{2m+1}OSO_3Na$ (where m is 10, 12, 14, 16 or 18).

Specific examples of the synthesis of compounds of the present invention are described below, but the present invention is not to be construed as being limited thereto.

SYNTHESIS EXAMPLE 1

Synthesis of Compound 1 of the Invention 440 ml of water, 5 g of sodium alkylbenzenesulfonate and 0.4 g of sodium persulfate were placed in a pressure glass reactor. After purging with nitrogen gas, a monomer mixture of 39 g of vinylidene chloride and 4.5 g of methyl methacrylate was introduced thereinto at 50° C. with stirring. It was confirmed by a drop in internal pressure that the reaction was completed. Further, a mixture of 351 g of vinylidene chloride and 39 g of methyl methacrylate was added thereto. It was confirmed by a drop in internal pressure that the reaction was completed. 0.05 g of sodium persulfate and 0.025 g of sodium sulfite were dissolved in 25 ml of water and the solution was added to the reactor. A monomer mixture of 60 g of vinylidene chloride, 5 g of acrylonitrile and 1.75 g of methacrylic acid was then added thereto. It was confirmed by a drop in internal pressure that the reaction was completed 30 ml of an aqueous solution of 10% sodium alkylbenzenesulfonate was added thereto to obtain the desired latex.

The solids content was 50.2% and the mean particle diameter was 148 nm.

It was found that compound 1 of the present invention had the following structure by elemental analysis and NMR spectrum.

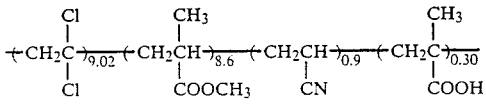

Synthesis Example 2

Synthesis of Compound 2 of the Invention

After 200 ml of water, 0.40 g of sodium hydrogensulfite and 4.8 g of sodium alkylbenzene sulfonate (a mixture mainly composed of a 12 C alkyl group) were purged with nitrogen gas, 216 g of vinylidene chloride, 24 g of methyl methacrylate and an aqueous solution of potassium persulfate (0.8 g/80 ml) were purged with nitrogen gas in a closed system and added dropwise thereto with stirring at 55° C. over a period of 12 hours. After addition, the mixture was stirred at 55° C. for three hours Further, 40 g of vinylidene chloride, 4.5 g of acrylonitrile and an aqueous solution of potassium persulfate (0.2 g/20 ml) were added dropwise thereto at 55° C. over a period of 4 hours. After addition, the mixture was stirred at 55° C. for 3 hours. Nitrogen gas was then bubbled through the reaction mixture to remove unreacted monomers, thus obtaining the desired latex.

The solids content was 49.6% and the average particle diameter was 81 nm.

Elemental analysis and NMR data showed that compound 2 of the invention had the following structure.

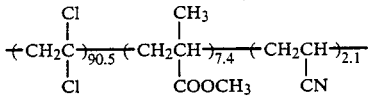

SYNTHESIS EXAMPLE 3

Synthesis of Compound 3 of the Invention

After 200 ml of water, 0.40 g of sodium hydrogensulfite and 4.8 g of sodium alkylbenzenesulfonate (a mixture mainly composed of a 12 C alkyl group) were purged with nitrogen gas, 216 g of vinylidene chloride, 21 g of methyl methacrylate and an aqueous solution of potassium persulfate (0.8 g/80 ml) were purged with nitrogen gas in a closed system and added dropwise thereto with stirring at 55° C. over a period of 12 hours. After addition, the mixture was stirred at 55° C. for 3 hours. Further, 54 g of vinylidene chloride, 3 g of acrylonitrile, 1.5 g of glycidyl methacrylate, 1.5 g of methacrylic acid and an aqueous solution of potassium persulfate (0.2 g/20 ml) were added dropwise thereto at 55° C. over a period of 4 hours. After addition, the mixture was stirred at 55° C. for 3 hours. Nitrogen gas was then bubbled through the reaction mixture to remove unreacted monomers, thus obtaining the desired latex.

The solids content was 49.8% and the average particle diameter was 78 nm.

Elemental analysis and NMR data showed that compound 3 of the invention had the following structure.

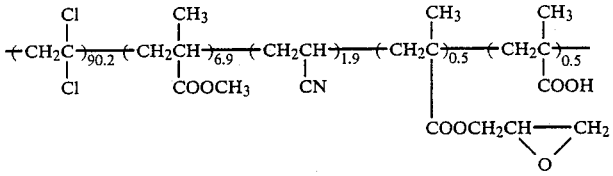

SYNTHESIS EXAMPLE 4

Compounds 4 to 20 of the invention were synthesized according to the methods of Synthesis Examples 1, 2 and 3.

| Compound No. | Comonomer for core $E_1$ | $E_2$ | Comonomer for shell $E_3$ | $E_4$ | $E_5$ | Vinylidiene chloride/$E_1$/$E_2$/$E_3$/$E_4$/$E_5$* (wt. ratio) | Solid content | Average particle diameter |
|---|---|---|---|---|---|---|---|---|
| 4 | MMA | — | AN | — | — | 90.1/9.0/—/0.9/—/— | 48.3 | 88 |
| 5 | MMA | — | MAN | — | — | 90.8 8.0 — 1.2 — — | 50.2 | 92 |
| 6 | MMA | — | MMA | MAA | — | 89.2 7.8 — 2.0 1.0 — | 49.1 | 130 |
| 7 | MMA | — | AN | itaconic acid | — | 90.1 7.5 — 1.5 0.9 — | 50.1 | 77 |
| 8 | MMA | MA | AN | MAA | — | 89.8 6.0 2.0 1.2 1.0 — | 49.8 | 83 |

-continued

| Compound No. | Comonomer for core $E_1$ | $E_2$ | Comonomer for shell $E_3$ | $E_4$ | $E_5$ | Vinylidiene chloride/$E_1$/$E_2$/$E_3$/$E_4$/$E_5$* (wt. ratio) | Solid content | Average particle diameter |
|---|---|---|---|---|---|---|---|---|
| 9 | MA | — | AN | — | — | 90.3 8.5 — 1.2 — — | 50.3 | 110 |
| 10 | MA | — | MAN | sodium methacryl-sulfonate | — | 88.8 9.5 — 1.5 0.2 — | 48.2 | 120 |
| 11 | MA | — | AA | — | — | 91.3 8.0 — 0.7 — — | 51.0 | 155 |
| 12 | MA | — | MA | AN | MAA | 89.7 7.6 — 1.1 1.1 0.5 | 50.3 | 88 |
| 13 | MA | BA | AN | — | — | 90.0 6.0 2.0 2.0 — — | 50.5 | 79 |
| 14 | MA | — | AN | I-1 | — | 90.7 7.2 — 1.3 0.8 — | 50.0 | 132 |
| 15 | EA | — | AN | AMPS | — | 90.3 7.2 — 2.0 0.5 — | 49.7 | 126 |
| 16 | EA | — | MAN | — | — | 90.0 7.6 — 2.4 — — | 49.8 | 107 |
| 17 | BA | — | AN | — | — | 88.9 8.6 — 2.5 — — | 50.3 | 95 |
| 18 | BA | — | MAN | — | — | 89.8 7.8 — 2.4 — — | 50.2 | 82 |
| 19 | MMA | — | MA | AN | — | 89.7 7.9 — 1.2 1.0 — | 50.4 | 91 |
| 20 | MA | — | MA | AN | — | 90.2 6.5 — 2.0 1.3 — | 49.8 | 142 |

*Estimation was made by charged ratios, when the same monomers were used for both the core and the shell.
MMA: methyl methacrylate
MA: methyl acrylate
EA: ethyl acrylate
BA: butyl acrylate
AN: acrylonitrile
MAN: methacrylonitrile
MAA: methacrylic acid
AA: acrylic acid AMPS: $CH_2{=}CH(CONHC(CH_3)_2CH_2SO_3Na)$

SYNTHESIS EXAMPLE 5

Synthesis of Compound 2' of the Invention

After 200 ml of water, 0.40 g of sodium hydrogensulfite and 4.8 g of sodium alkyl benzene sulfonate (a mixture mainly composed of an 12 C alkyl group) were purged with nitrogen gas, 216 g of vinylidene chloride, 24 g of methyl methacrylate and an aqueous solution of potassium persulfate (0.8 g/80 ml) were purged with nitrogen gas in a closed system and added dropwise thereto with stirring at 50° C. over a period of 12 hours. After addition, the mixture was stirred at 55° C. for 3 hours. Further, 40 g of vinylidene chloride, 3 g of acrylonitrile, 1.5 g of methacrylic acid and an aqueous solution of potassium persulfate (0.2 g/20 ml) were added dropwise thereto at 55° C. over a period of 4 hours. After addition, the mixture was stirred at 55° C. for 3 hours. Nitrogen gas was then bubbled through the reaction mixture to remove unreacted monomers, thus obtaining the desired latex.

The solids content was 49.8% and the average particle diameter was 76 nm. Elemental analysis and NMR data showed that compound 2' of the invention had the following structure.

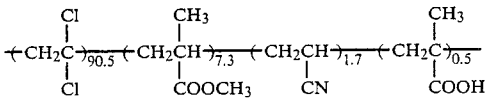

SYNTHESIS EXAMPLE 6

Synthesis of Compound 3' of the Invention

The procedure of synthesis Example 1 was repeated except that sodium lauryl sulfate was used as the emulsifying agent in place of sodium alkylbenzenesulfonate to obtain the desired latex.

The solids content was 49.2% and the average particle diameter was 83 nm. Elemental analysis and NMR data showed that compound 3' of the invention had the following structure.

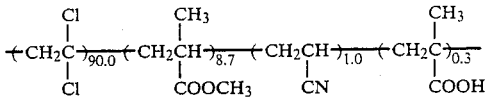

SYNTHESIS EXAMPLE 7

The compounds 4' to 20' of the invention were synthesized according to the methods of Synthesis Examples 1 and 2.

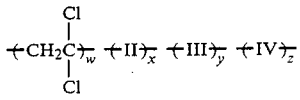

| Compound No. | II | III | IV | Other monomer | According to method of Synthesis Ex. | Emulsifying agent | w/x/y/z (wt %) | Solid content (wt %) | Average particle diameter (nm) |
|---|---|---|---|---|---|---|---|---|---|
| 4' | II-4 | III-2 | IV-1 | — | 1 | $D_1$ | 90.1/8.8/0.9/0.2 | 50.6 | 132 |
| 5' | II-4 | III-2 | IV-2 | — | 2 | $D_1$ | 89.8/8.8/1.1/0.3 | 48.8 | 110 |
| 6' | II-4 | III-1 | IV-1 | — | 1 | $D_1$ | 91.5/6.8/1.2/0.5 | 49.2 | 128 |
| 7' | II-1 | III-1 | IV-2 | — | 2 | $D_2$ | 90.3/8.6/0.8/0.3 | 51.1 | 105 |
| 8' | II-1/ II-4 | III-1 | IV-2 | — | 1 | $D_1$ | 89.7/8.4/1.5/0.4 | 45.5 | 88 |

-continued

| Compound No. | II | III | IV | Other monomer | According to method of Synthesis Ex. | Emulsifying agent | w/x/y/z (wt %) | Solid content (wt %) | Average particle diameter (nm) |
|---|---|---|---|---|---|---|---|---|---|
| 9′ | (1/3) II-4 | III-1 | IV-1/ IV-2 (1/1) | — | 2 | $D_2$ | 89.0/8.9/1.8/0.3 | 49.7 | 128 |
| 10′ | II-4 | III-1 | IV-2 | — | 1 | $D_2$ | 90.0/8.7/0.9/0.4 | 49.6 | 139 |
| 11′ | II-4 | III-1 | IV-2 | — | 2 | $D_1/D_2$ (1/1) | 90.2/8.4/1.0/0.4 | 48.8 | 97 |
| 12′ | II-4 | III-1 | IV-4 | — | 1 | $D_1$ | 90.5/8.2/1.1/0.2 | 38.8 | 155 |
| 13′ | II-4 | III-1 | IV-3 | — | 1 | $D_1$ | 90.3/7.6/1.4/0.7 | 42.6 | 146 |
| 14′ | II-4 | III-1 | IV-6 | — | 1 | $D_2$ | 91.3/6.4/1.3/1.0 | 43.2 | 101 |
| 15′ | II-4 | III-2 | IV-2 | $CH_2{=}C(CH_3)COOCH(\overset{O}{\triangle})CH_2$ | 2 | $D_1$ | 90.7/7.2/1.1/0.5/0.5 | 47.2 | 83 |
| 16′ | II-2 | III-1 | IV-2 | — | 2 | $D_4$ | 89.8/7.6/1.1/1.5 | 45.8 | 77 |
| 17′ | II-5 | III-1 | IV-2 | — | 2 | $D_5$ | 89.9/7.3/2.5/0.3 | 43.6 | 78 |
| 18′ | II-3 | III-1 | IV-2 | — | 1 | $D_6$ | 90.1/7.7/1.7/0.5 | 38.2 | 115 |
| 19′ | II-6 | III-1 | IV-2 | — | 2 | $D_7$ | 90.7/6.9/1.8/0.6 | 39.6 | 82 |
| 20′ | II-9 | III-1 | IV-2 | — | 2 | $D_8$ | 91.0/6.0/1.0/2.0 | 40.3 | 85 |

In the above Table,
$D_1$: sodium alkylbenzenesulfonate
$D_2$: sodium lauryl sulfate
$D_3$: $C_nH_{2n+1}SO_3Na$

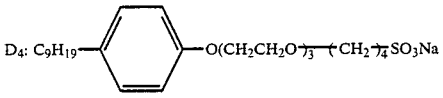

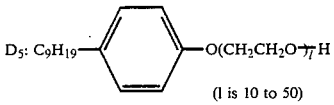

(l is 10 to 50)

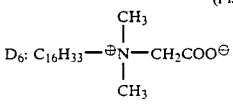

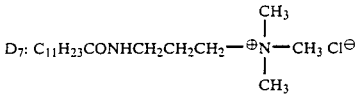

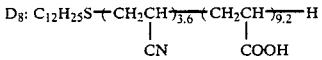

SYNTHESIS EXAMPLE 8

Synthesis of Comparative Compound 101

After 200 ml of water, 2.8 g of sodium lauryl sulfate and 0.75 of potassium persulfate were purged with nitrogen gas, a monomer mixture consisting of 270 g of vinylidene chloride, 22.5 g of methyl methacrylate and 7.5 g of acrylonitrile and an aqueous solution of sodium hydrogensulfite (0.65 g/100 ml) were purged with nitrogen gas in a closed system and added dropwise thereto with stirring at 43° C. over a period of 8 hours. After addition, the mixture was stirred at 45° C. for 2 hours. Nitrogen gas was then bubbled through the reaction mixture to remove unreacted monomers. Further, 200 g of sodium lauryl sulfate was added thereto to obtain the desired latex.

The solids content was 50.1% and the average particle diameter was 83 nm. Elemental analysis and NMR data showed that comparative compound 101 had the following structure.

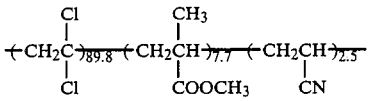

SYNTHESIS EXAMPLE 9

Synthesis of Comparative Compound 102

After 200 ml of water, 2.8 g of sodium alkylbenzenesulfonate and 0.75 g of potassium persulfate were purged with nitrogen gas, a monomer mixture consisting of 270 g of vinylidene chloride, 25 g of methyl methacrylate, 3.0 g of acrylonitrile and 1.5 g of VI-2 and an aqueous solution of sodium hydrogensulfite (0.65 g/100 ml) were purged with nitrogen gas in a closed system and added dropwise thereto with stirring at 50° C. over a period of 16 hours. After addition, the mixture was stirred at 50° C. for 2 hours. Nitrogen gas was then bubbled through the reaction mixture to remove unreacted monomers. Further, 2.0 g of sodium alkylbenzenesulfonate was added thereto to obtain the desired latex.

The solids content was 50.8% and the average particle diameter was 87 nm. Elemental analysis and NMR data showed that comparative compound 102 had the following structure.

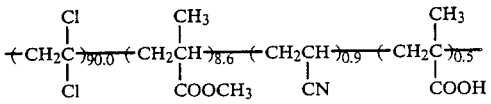

SYNTHESIS EXAMPLE 10

Comparative Compounds 103 and 104 were synthesized according to the method of synthesis Example 5.

Comparative Compound 103

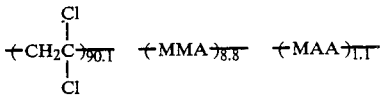

solid content: 49.8%
average particle diameter: 83 nm

Comparative Compound 104

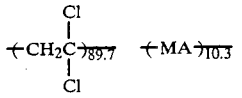

solid content: 50.1%
average particle diameter: 95 nm

SYNTHESIS EXAMPLE 11

Comparative Compounds 101′ to 103′ were synthesized according to the methods of Synthesis Examples 4 and 5.

Comparative Compound 101′

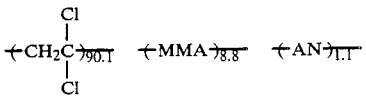

solid content: 48.9%
average particle diameter: 89 nm

Comparative Compound 102′

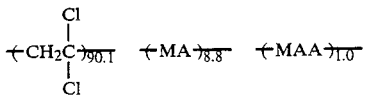

solid content: 45.5%,
average particle diameter: 78 nm

Comparative Compound 103′

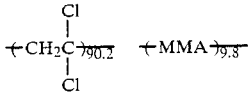

solid content: 48.3%,
average particle diameter: 83 nm

In the present invention, a hydrophilic colloid layer is obtained by coating an aqueous coating solution of the hydrophilic colloid and subsequently drying it. The coating solution generally includes hydrophilic colloid binder, silver halide grains, surface active agent, aqueous additives such as a gelatin hardner, additives which are dispersed in water, such as matting agent, polymer-latex, etc., and additives for photographic materials.

The polyester support can be coated with the vinylidene chloride copolymer latex of the present invention by any of conventional coating methods such as dip coating method, air knife coating method, curtain coating method, roller coating method, wire bar coating method and gravure coating method or an extrusion coating method using a hopper described in U.S. Pat. No. 2,681,294.

Examples of the hydrophilic colloid layers of the photographic material of the present invention include silver halide emulsion layers, a backing layer, protective layer, and intermediate layer. Hydrophilic colloids are used for these layers. As the hydrophilic colloid, gelatin is most preferred. Any of lime-processed gelatin, acid-processed gelatin, enzyme-processed gelatin, gelatin derivatives and modified gelatin can be used. Among them, lime-processed gelatin and acid-processed gelatin are preferred.

In addition to gelatin, there can be used proteins such as colloidal albumin and casein; cellulose derivatives such as carboxymethyl cellulose and hydroxyethyl cellulose; saccharide derivatives such as agar-agar, sodium alginate and starch derivatives; and synthetic hydrophilic colloids such as polyvinyl alcohol, poly-N-vinylpyrrolidone, polyacrylic acid copolymers, polyacrylamide and derivatives thereof and partial hydrolyzates thereof. If desired, a mixture of two or more of them may be used.

In the present invention, the coated hydrophilic colloid layer on the polyester support after coating is dried to such an extent that the water content thereof is reduced to 8 wt % or lower based on the amount (on a dry basis) of the binder at a drying rate within 100 seconds. Drying must be conducted at a temperature of not higher than 35° C. and at a relative humidity of not higher than 50% during the period during which 300 wt % or less based on the amount, on a dry basis, of the binder contained in the whole of layers is dried.

When two or more hydrophilic colloid layers are coated and simultaneously dried, the sum of water contents contained in all of the layers is referred to as the amount of water and the amount, on a dry basis, of the binder is the sum of the amounts, on a dry basis, of the binders contained in all of the layers.

The term "relative humidity" as used herein refers to the ratio (in percentage) of the amount of steam contained in a given volume to the amount of saturated steam in air therein.

The drying time required for reducing the water content of the photographic material of the present invention to 8 wt % or lower, is 100 seconds or shorter, preferably 30 to 95 seconds, more preferably 50 to 90 seconds. When the coating solution contains 300 wt % or more of water in the total drying stage, the drying temperature is preferably from 30 to 50° C. to conduct drying in the total drying time within 100 seconds, though there are no particular limitations with regard to conditions for drying 300 wt % or more of water.

The conditions for the stage for drying 300 wt % or less of water is such that temperature is not higher than 35° C., preferably 25 to 35° C. and the relative humidity is not higher than 50%, preferably 35 to 50%.

It is desirable that the silver halide photographic material of the present invention is preserved in an atmosphere at a RH of not higher than 1% after the completion of drying to keep improved dimensional stability. It is generally necessary to initiate a crosslinking reaction between the hydrophilic colloid and a hardening agent and to stabilize the physical properties of coated films. It is preferred that the coated films after coating are heat-treated at a temperature of 30° C. or higher in an atmosphere at an absolute humidity of not higher than 1%.

The heat treatment is described in more detail in Japanese Patent Application No. 63-55586.

Further, it is preferred that the photographic materials in bulk are covered with a plastic film and stored during the period of a time after the completion of drying till the heat treatment. It is also necessary that the photographic materials in bulk are stored at a temperature as low as possible.

In order to further improve the adhesion of the polyester support to the polymer, the surface of the polyester support may be subjected to treatments such as chemical treatment, mechanical treatment, corona discharge treatment, flame treatment, ultraviolet light treatment, high frequency treatment, glow discharge treatment, active plasma treatment, high-pressure steam treatment, desorption treatment, laser treatment, mixed acid treatment and ozone oxidizing treatment.

Further, in order to bond the polymer layer of the present invention firmly to the polyester support, it is helpful to add wetting agents such as phenol, resorcin, o-cresol, m-cresol, trichloroacetic acid, dichloroacetic acid, monochloroacetic acid, chloral hydrate and benzyl alcohol as disclosed in U.S. Pat. Nos. 3,245,937, 3,143,421, 3,501,301 and 3,271,178. Among these wetting agents, resorcin is preferred. However, resorcin has a disadvantage that spots are often caused in the manufacturing stage.

A preferred method for eliminating the problem is to provide the polymer layer of the present invention after the surface of the polyester support is subjected to glow discharge treatment.

In the present invention, the glow discharge treatment may be carried out by any conventional method, such as the treatments described in Nos. JP-B-35-7578, JP-B36-10336, JP-B-45-22004, JP-B-45-22005, JP-B-45-24040, JP-B-46-43480, U.S. Pat. Nos. 3,057,792, 3,057,795, 3,179,482, 3,288,638, 3,309,299, 3,424,735, 3,462,335, 3,475,307 and 3,761,299 and U.K. Patent No. 997,093 and No. JP-A-53-129262.

The pressure during glow discharge is in the range of 0.005 to 20 Torr, preferably 0.02 to 2 Torr. When the pressure is too low, the surface treating effect is low, while when pressure is too high, excess current flows, sparks are liable to be generated, such high pressure is dangerous and materials to be treated are broken. Discharging is caused by applying high voltage to a gap between at least one pair of metallic sheets or rods opposed to each other at a given distance therebetween in a vacuum tank. Voltage varies depending on the compositions of atmospheric gases, pressure, etc. Generally, stable fixing glow discharge is caused at a voltage of 500 to 5000 V in the pressure range described above. A particularly preferred voltage range for improving adhesion is from 2000 to 4000 V.

The discharge frequency range is from DC to several thousand MHz, preferably from 50 Hz to 20 MHz as in conventional treatments. The intensity of discharge treatment is from 0.01 to 5 KV·A·min/$m^2$, preferably 0.05 to 1 KV.A.min/$m^2$ to obtain the desired adhesion performance.

An undercoat layer having adhesion to both the polyester support and the polymer layer may be provided to improve adhesion between the support and the polymer layer.

Water-soluble polyesters and urethane compounds, can be used as undercoating agents. Commercially available anchor coating agents such as Bairon (a product of Toyobo Co., Ltd.), Julimer (a product of Nippon Junyaku KK) and Polysol (a product of Showa Highpolymer Co., Ltd.) can be used.

The details of each layer of the present invention are disclosed, for example, in EP No. 279450 $A^2$, No. JP-A-64-538, etc.

The coating solutions of the vinylidene chloride copolymers of the present invention may contain compounds known as curing agents by those skilled in the art. For example, the coating solutions of the present invention may contain triazine compounds described in U.S. Pat. Nos. 3,325,287, 3,288,775 and 3,549,377, Belgian Patent No. 6,602,226; dialdehyde compounds described in U.S. Pat. Nos. 3,291,624 and 3,232,764, French Patent No. 1,543,694 and U.K. Patent No. 1,270,578; epoxy compounds described in U.S. Pat. No. 3,091,537 and No. JP-B-49-26580; vinyl compounds described in U.S. Pat. No. 3,642,486; aziridine compounds described in U.S. Pat. No. 3,392,024; and ethyleneimine compounds and methylol compounds described in U.S. Pat. No. 3,549,378.

Among these curing agents, triazine compounds, dialdehyde compounds and epoxy compounds are preferred.

These curing agents are used in an amount of 0.001 to 30 g per one liter of the coating solution.

It is preferred that the vinylidene chloride copolymer layer of the present invention be thick to prevent the support from being stretched (elongated) by water absorption during development. However, when the layer is too thick, adhesion to silver halide emulsion layer becomes poor. Generally, the thickness is from 0.3 to 5 μm, preferably 0.5 to 2.0 μm.

Polyesters which are used in the present invention are those mainly composed of aromatic dibasic acids and glycols. Typical examples of the aromatic dibasic acids include terephthalic acid, isophthalic acid, p-β-oxyethoxybenzoic acid, diphenylsulfonedicarboxylic acid, diphenoxyethanedicarboxylic acid, adipic acid, sebacic acid, azelaic acid, 5-sodium sulfoisophthalic acid, diphenylenedicarboxylic acid and 2,6-naphthalenedicarboxylic acid. Typical examples of the glycols include ethylene glycol, propylene glycol, butanediol, neopentylene glycol, 1,4-cyclohexanediol, 1,4-cyclohexanedimethanol, 1,4-bisoxyethoxybenzene, bisphenol A, diethylene glycol and polyethylene glycol.

Among the polyesters composed of these ingredients, polyethylene terephthalate is most preferred because of its ready availability.

Though there are no particular limitations with regard to the thickness of the polyester, the thickness is generally about 12 to 500 μm, preferably 40 to 200 μm from the viewpoints of easy handleability and general purpose properties. Biaxially oriented crystalline polyesters are particularly preferred from the viewpoints of good stability and high strength.

An undercoat layer having adhesion to both the polymer layer and the emulsion layer may be provided to improve adhesion between the polymer layer and the emulsion layer. As undercoating materials, there can be used gelatin, copolymers of styrene with butadiene, vinylidene chloride, aqueous polyesters and aqueous polyurethane. An undercoat layer containing vinylidene chloride is particularly preferred because a remarkable effect of improving dimensional stability can be obtained. If desired, the surface of the polymer layer may be subjected to conventional pretreatments such as corona discharge treatment, ultraviolet light irradiation treatment and flame treatment to further improve adhesion.

It is preferred to use a polymer latex in the hydrophilic colloid of the present invention. Preferred polymer latexes are aqueous dispersions of waterinsoluble polymers having an average particle diameter of 20 to 700 mμ. The polymer latex is used in a weight ratio of the latex to gelatin as the binder of from 0.01 –1.0 to 1.0, preferably from 0.1–0.8 to 1.0 on a dry basis.

Preferred examples of the polymer latexes include, but are not limited to, those having repeating units composed of monomers represented by the following general formulas (P–I) to (P–XVIII).

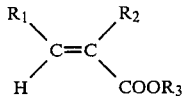
(P-I)

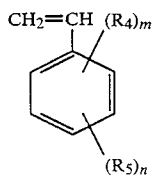
(P-II)

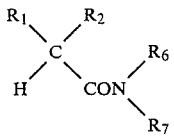
(P-III)

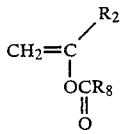
(P-IV)

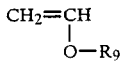
(P-V)

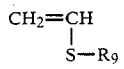
(P-VI)

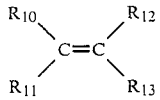
(P-VII)

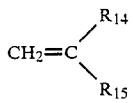
(P-VIII)

-continued

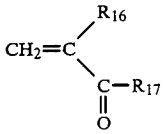
(P-IX)

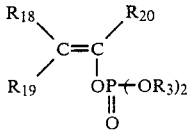
(P-X)

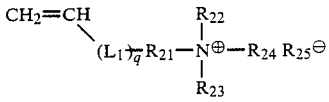
(P-XI)

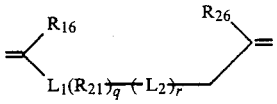
(P-XII)

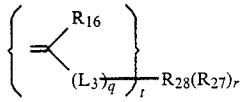
(P-XIII)

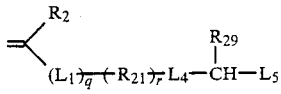
(P-XIV)

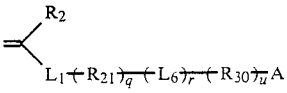
(P-XV)

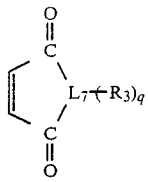
(P-XVI)

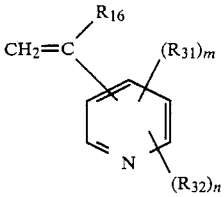
(P-XVII)

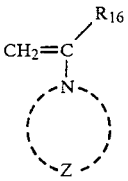
(P-XVIII)

In the formulas, $R_1$ represents hydrogen, a carboxyl group or a salt thereof.

$R_2$ represents hydrogen, an alkyl group having 1 to 18 carbon atoms, a substituted alkyl group containing 1 to 36 carbon atoms, a halogen atom or a cyano group.

$R_3$ represents hydrogen, an alkyl group having 1 to 6 carbon atoms, a substituted alkyl group wherein the alkyl moiety has 1 to 6 carbon atoms, an aryl group having 6 to 9 carbon atoms or a substituted aryl group containing 6 to 14 carbon atoms.

$R_4$ and $R_5$ are the same or different groups and each is hydrogen, an alkyl group having 1 to 6 carbon atoms, a substituted alkyl group containing 1 to 36 carbon atoms, a carboxyl group or a salt thereof, —COOR3 (wherein $R_3$ is as defined above), a halogen atom, a hydroxyl group or a salt thereof, a cyano group or a carbamoyl group.

m represents 0, 1 or 2 and n represents 0, 1 or 2.

$R_6$ and $R_7$ are the same or different and each is hydrogen, an alkyl group having 1 to 18 carbon atoms, a substituted alkyl group containing 1 to 36 carbon atoms, a phenyl group or a substituted phenyl group.

$R_8$ represents an alkyl group having 1 to 18 carbon atoms, a substituted alkyl group containing 1 to 36 carbon atoms, a phenyl group or a substituted phenyl group.

$R_9$ represents an alkyl group having 1 to 18 carbon atoms or a substituted alkyl group containing 1 to 18 carbon atoms.

$R_{10}$, $R_{11}$, $R_{12}$ and $R_{13}$ are the same or different and each is hydrogen, an alkyl group having 1 to 6 carbon atoms, a substituted alkyl group containing 1 to 6 carbon atoms, a halogen atom or a cyano group.

$R_{14}$ represents hydrogen, an alkyl group having 1 to 6 carbon atoms or a halogen atom.

$R_{15}$ represents an alkenyl group having 2 to 18 carbon atoms.

$R_{16}$ represents hydrogen, an alkyl group having 1 to 6 carbon atoms or a substituted alkyl group containing 1 to 6 carbon atoms.

$R_{17}$ represents an alkyl group having 1 to 18 carbon atoms or a substituted alkyl group containing 1 to 18 carbon atoms.

$R_{18}$ represents hydrogen, an alkyl group having 1 to 6 carbon atoms or an alkenyl group having 2 to 8 carbon atoms.

$R_{19}$ and $R_{20}$ are the same or different and each is hydrogen or an alkyl group having 1 to 6 carbon atoms.

$R_{21}$ represents an alkylene group having 1 to 8 carbon atoms, a substituted alkylene group containing 1 to 32 carbon atoms or a group of the formula $CH_{2x}OCH_{2y}O_wH_{2v}$ (wherein x, y, w and v each is 0 or 1).

$L_1$ represents -COO-, a phenylene group of

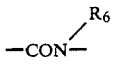

(wherein $R_6$ is as defined above).

q represents 0 or 1 and when q=0, $R_{21}$-N may form a pyridine ring.

$R_{22}$, $R_{23}$ and $R_{24}$ are the same or different and each is an alkyl group having 1 to 8 carbon atoms or a substituted alkyl group containing 1 to 8 carbon atoms, $R_{25}\ominus$ represents an anion.

$R_{26}$ represents hydrogen, an alkyl group having 1 to 6 carbon atoms or a substituted alkyl group containing 1 to 6 carbon atoms.

$L_1$ and $L_2$ are the same or different and each is —COO—,

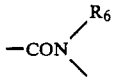

(wherein $R_6$ is as defined above), —O—, —S—, —OOC—, —CO— or a phenylene group.

r represents 0 or 1.

$L_3$ represents —COO—,

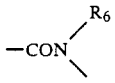

(wherein $R_6$ is as defined above) or —OOC—.

$R_{27}$ represents hydrogen, an alkyl group having 1 to 18 carbon atoms or a substituted alkyl group containing 1 to 18 carbon atoms.

t represents 3 or 4.

$R_{28}$ represents carbon atom,

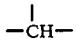

or a heterocyclic ring.

$L_4$ represents —OOC—, —CO—,

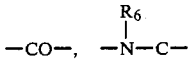

(wherein $R_6$ is as defined above) or

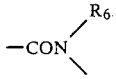

(wherein $R_6$ is as defined above).

$L_5$ represents —CO—$R_{17}$ (wherein $R_{17}$ is as defined above), —COO—$R_{17}$ (wherein $R_{17}$ is as defined above), a cyano group,

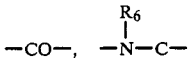

(wherein $R^6$ is as defined above) or —$SO_2$—$R_{17}$ (wherein $R_{17}$ is as defined above).

$R_{29}$ represents hydrogen or —CO—$R_{17}$ (wherein $R_{17}$ is as defined above).

$L_6$ represents

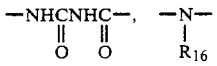

(wherein $R_{16}$ is as defined above

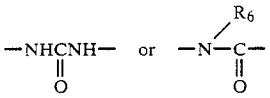

(wherein $R_6$ is as defined above).

$L_7$ represents oxygen or nitrogen.

$R_{30}$ represents an alkylene group having 1 to 8 carbon atoms or a triazole ring.

A represents a halogen atom or amino group, provided that when $R_{30}$ is a triazole ring, A may be two or more halogen atoms.

$R_{31}$ and $R_{32}$ are the same or different and each is hydrogen, an alkyl group having 1 to 6 carbon atoms, a substituted alkyl group containing 1 to 6 carbon atoms, a hydroxyl group or a salt thereof, an amino group, a carboxyl group or a salt thereof, or a cyano group.

Z is a group which is combined together with N to form a heterocyclic ring having 3 to 13 carbon atoms.

Examples of substituents group for the substituted alkyl group and substituted alkenyl group represented by $R^1$ to $R^{32}$ include a halogen atoms, cyano group, phosphonic acid group, hydroxy group, carboxy group or salts thereof, sulfonic acid group or salts thereof, sulfinic acid group or salts thereof, nitro group, mercapto group, substituted or unsubstituted alkoxy group, phenoxy group, alkylthio group, phenyl group, amino group, alkylcarbamoyl group, phenylcarbamoyl group, alkylcarbonyl group, phenylcarbonyl group, alkyloxycarbonyl group, phenyloxycarbonyl group, carbamoyl group, sulfamoyl group, alkylsulfonyl group, phenylsulfonyl group, alkylsulfinyl group, phenylsulfinyl group, alkylsulfonate group, phenylsulfonate group, alkylcarbonate group, phenylcarbonate group, alkylcarbonamido group, phenylcarbonamido group, alkylsulfonamide group, phenylsulfonamide group, etc.

Examples of substituent groups for the substituted arylene group represented by $R^1$ to $R^{32}$ and the substituents group for the substituted phenylene group represented by $L^1$ and $L^2$ include alkyl group and substituent groups for the substituted alkyl group disclosed above.

Examples of the monomers represented by the formula (P-1) include those in the following Table, but the present invention is not to be construed as being limited thereto. The description of specific compounds below is similarly not to be construed as limiting the invention in any way.

| Monomer No. | $R_1$ | $R_2$ | $R_3$ |
|---|---|---|---|
| M-1 | H | H | H |
| M-2 | H | H | $-CH_3$ |
| M-3 | H | H | $-C_2H_5$ |
| M-4 | H | H | $-C_3H_7(n)$ |
| M-5 | H | H | $-C_4H_9(n)$ |
| M-6 | H | H | $-CH_2CH(\diagdown O \diagdown)CH_2$ |
| M-7 | H | H | $-C_6H_{13}(n)$ |
| M-8 | H | H | $-C_{16}H_{33}(n)$ |
| M-9 | H | H | $-CH(CH_2CH_3)_2$ |
| M-10 | H | H | 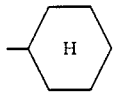 |
| M-11 | H | H | 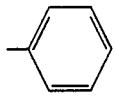 |
| M-12 | H | H | $-CH_2CH_2CH_2SO_3Na$ |
| M-13 | H | H | $-CF_2CF_2CF_2CF_2H$ |
| M-14 | H | H | $-CH_2CH_2OCH_3$ |
| M-15 | H | H | $-CH_2CH_2OC_2H_5$ |
| M-16 | H | H | $-CH_2CH_2SCH_2$ |
| M-17 | H | H | $-CH_2CH_2CN$ |
| M-18 | H | H | 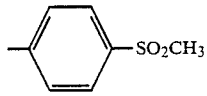 |
| M-19 | H | H | $-CH_2CH_2N(C_2H_5)_2$ |
| M-20 | H | H | $-CH_2CH_2(OCH_2CH_2)_8OH$ |
| M-21 | H | H | $-CH_2CH_2-O\overset{O}{\overset{\|}{P}}(OH)-OH$ |
| M-22 | H | $CH_3$ | H |
| M-23 | H | $CH_3$ | $-C_2H_5$ |
| M-24 | H | $CH_3$ | $-CH_2CH_2OH$ |
| M-25 | H | $CH_3$ | $-CH_2CH_2OOCCH_2CH_2COOH$ |
| M-26 | H | $-Cl$ | $-H$ |
| M-27 | H | $-COOH$ | $-H$ |
| M-28 | $-COOH$ | $-COOH$ | $-H$ |

-continued

| Monomer No. | $R_1$ | $R_2$ | $R_3$ |
|---|---|---|---|
| M-29 | —COOH | Cl | H |
| M-30 | H | —$CH_2COOH$ | $CH_3$ |

Examples of the monomers represented by the formula (P-II) include the following compounds, but the present invention is not to be construed as being limited thereto.

| Monomer No. | $R_4$ | $R_5$ |
|---|---|---|
| M-31 | H | H |
| M-32 | P—COOH | H |
| M-33 | P—Cl | H |
| M-34 | m-Cl | P—Cl |
| M-35 | P—$SO_2CH_3$ | H |
| M-36 | O—$SO_3C_2H_5$ | P—$SO_3C_2H_5$ |
| M-37 | O—$CH_3$ | H |
| M-38 | —$SO_3Na$ | H |
| M-39 | —$SO_2K$ | H |
| M-40 | m-$CH_2OC(=O)CH_3$ | H |

Examples of the monomers represented by the formula (P-III) include compounds given in the following Table.

| Monomer No. | $R_1$ | $R_2$ | $R_6$ | $R_7$ |
|---|---|---|---|---|
| M-41 | H | H | H | —$C_3H_7$(iso) |
| M-42 | H | H | —$C_2H_5$ | —$C_2H_5$ |
| M-43 | H | H | H | —$CH_2CH_2SCH_3$ |
| M-44 | H | H | H | —$CH_2COOC_2H_5$ |
| M-45 | H | H | —$CH(CH_3)CH_2SCH_3$ | —$CH(CH_3)CH_2SCH_3$ |
| M-46 | H | $CH_3$ | H | 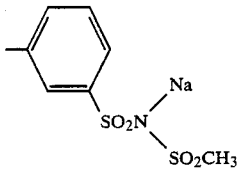 |
| M-47 | H | $CH_3$ | H | 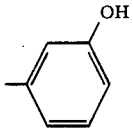 |
| M-48 | H | $CH_3$ | —$CH_2CN$ | —$CH_2CN$ |
| M-49 | —$CH_2CH_2N(CH_3)_2$ | $CH_3$ | H | H |
| M-50 | H | H | H | H |
| M-51 | H | H | H | —$C(CH_3)_2CH_2SO_3Na$ |

Examples of the monomers represented by the formula (P-IV) include the following compounds.

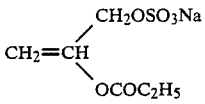

M-52

-continued

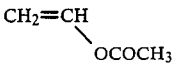

M-53

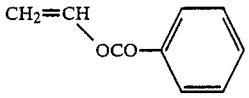

M-54

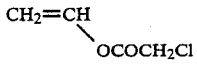

M-55

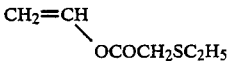

M-56

Examples of the monomers represented by the formula (P-V) include the following compounds.

$CH_2=CH-OCH_3$ M-57

$CH_2=CH-OC_4H_9(n)$ M-58

Examples of the monomers represented by the formula (P-VI) include the following compounds.

$CH_2=CH-S-CH_2CH_2CH_2SCH_3$ M-59

-continued $CH_2{=}CH{-}S{-}CH_2SCH_3$ M-60

Examples of the monomers represented by the formula (P-VII) include the following compounds.

$CH_2{=}CHCN$ M-61

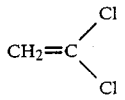
M-62

$ClCH_2{=}CCl_2$ M-63

Examples of the monomers represented by the formula (P-VIII) include the following compounds.

$CH_2{=}CHCH{=}CH_2$ M-64

$CH_2{=}CH\overset{CH_3}{\overset{|}{C}}H{=}CH{=}CH{=}CH_2$ M-65

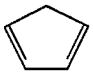
M-66

Examples of the monomers represented by the formula (P-IX) include the following compounds.

$CH_2{=}CHCOCH_3$ M-67

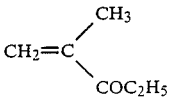
M-68

Examples of the monomers represented by the formula (P-X) include the following compounds.

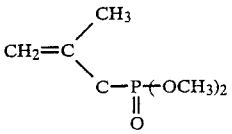
M-69

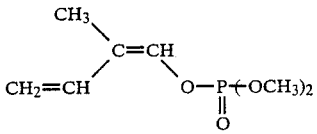
M-70

Examples of the monomers represented by the formula (P-XI) include the following compounds.

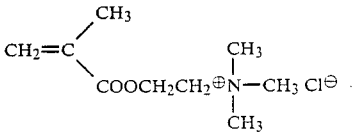
M-71

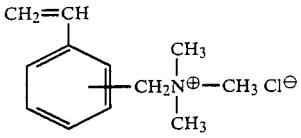
M-72

-continued

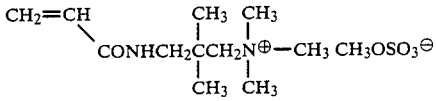
M-73

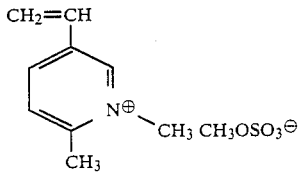
M-74

Examples of the monomers represented by the formula (P-XII) include the following compounds.

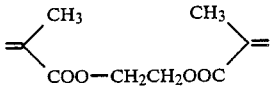
M-75

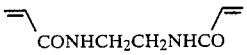
M-76

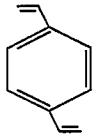
M-77

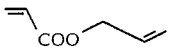
M-78

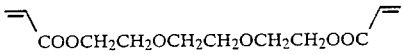
M-79

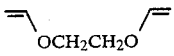
M-80

Examples of the monomers represented by the formula (P-XIII) include the following compounds.

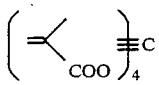
M-81

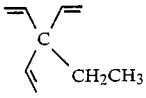
M-82

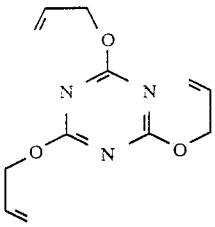
M-83

-continued

M-84

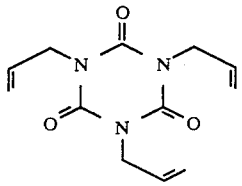

Examples of the monomers represented by the formula (P-XIV) include the following compounds.

M-85

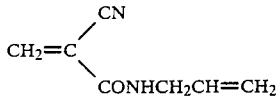

M-86

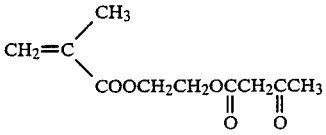

M-87

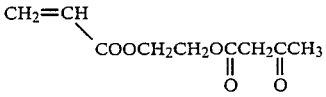

M-88

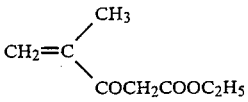

M-89

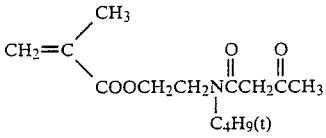

M-90

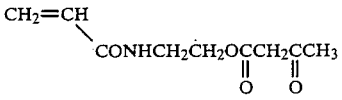

Examples of the monomers represented by the formula (P-XV) include the following compounds.

M-91

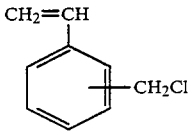

M-92

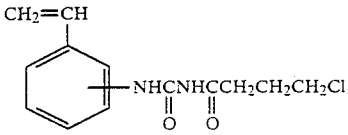

M-93

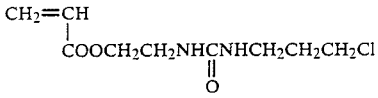

-continued

M-94

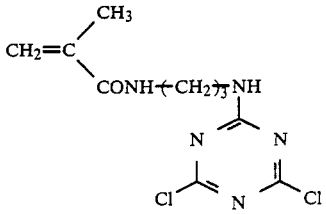

M-95

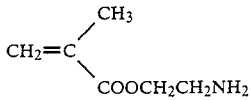

Examples of the monomers represented by the formula (P-XVI) include the following compounds.

M-96

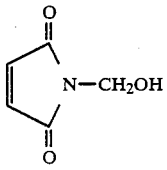

M-97

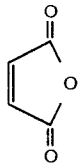

Examples of the monomers represented by the formula (P-XVII) include the following compounds.

M-98

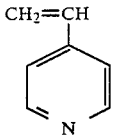

M-99

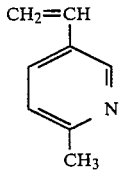

Examples of the monomers represented by the formula (P-XVIII) include the following compounds.

M-100

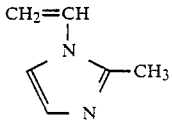

M-101

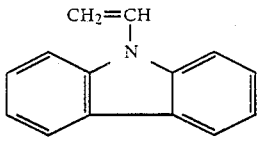

-continued

M-102

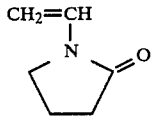

Examples of the polymer latexes included in the hydrophilic colloid layer include those given in the following Table.

| $(M_1)_a$ $(M_2)_b$ $(M_3)_c$ $(M_4)_d$ a/b/c/d; molar ratio | | | | | | | | |
|---|---|---|---|---|---|---|---|---|
| Polymer Latex No. | $M_1$ | a | $M_2$ | b | $M_3$ | c | $M_4$ | d |
| E-1 | M-3 | 1.0 | | | | | | |
| E-2 | M-1 | 0.05 | M-3 | 0.95 | | | | |
| E-3 | M-1 | 0.2 | M-75 | 0.8 | | | | |
| E-4 | M-3 | 0.85 | M-12 | 0.15 | | | | |
| E-5 | M-1 | 0.08 | M-61 | 0.27 | M-5 | 0.65 | | |
| E-6 | M-3 | 0.7 | M-61 | 0.3 | | | | |
| E-7 | M-1 | 0.04 | M-3 | 0.68 | M-31 | 0.28 | | |
| E-8 | M-5 | 0.58 | M-22 | 0.08 | M-31 | 0.24 | M-98 | 0.10 |
| E-9 | M-5 | 0.40 | M-31 | 0.60 | | | | |
| E-10 | M-3 | 0.78 | M-22 | 0.22 | | | | |
| E-11 | M-1 | 0.40 | M-14 | 0.40 | M-77 | 0.20 | | |
| E-12 | M-5 | 0.95 | M-51 | 0.05 | | | | |
| E-13 | M-5 | 0.90 | M-51 | 0.10 | | | | |
| E-14 | M-31 | 0.90 | M-51 | 0.10 | | | | |
| E-15 | M-5 | 0.80 | M-51 | 0.10 | M-77 | 0.10 | | |
| E-16 | M-5 | 0.30 | M-31 | 0.65 | M-51 | 0.05 | | |
| E-17 | M-31 | 0.45 | M-22 | 0.45 | M-51 | 0.10 | | |
| E-18 | M-5 | 0.80 | M-41 | 0.10 | M-51 | 0.10 | | |
| E-19 | M-5 | 0.20 | M-50 | 0.30 | M-51 | 0.45 | M-51 | 0.05 |
| E-20 | M-5 | 0.95 | M-39 | 0.05 | | | | |
| E-21 | M-2 | 1.0 | | | | | | |
| E-22 | M-61 | 1.0 | | | | | | |
| E-23 | M-62 | 0.88 | M-22 | 0.10 | M-27 | 0.02 | | |
| E-24 | M-3 | 0.25 | M-22 | 0.02 | M-27 | 0.73 | | |
| E-25 | M-1 | 0.08 | M-61 | 0.27 | M-14 | 0.65 | | |
| E-26 | M-1 | 0.08 | M-61 | 0.27 | M-15 | 0.65 | | |
| E-27 | M-3 | 0.67 | M-61 | 0.29 | M-1 | 0.04 | | |
| E-28 | M-1 | 0.04 | M-5 | 0.67 | M-31 | 0.29 | | |
| E-29 | M-5 | 0.56 | M-19 | 0.13 | M-22 | 0.07 | M-31 | 0.24 |
| E-30 | M-3 | 0.63 | M-19 | 0.07 | M-22 | 0.03 | M-31 | 0.27 |
| E-31 | M-50 | 0.16 | M-5 | 0.28 | M-31 | 0.52 | M-98 | 0.04 |
| E-32 | M-22 | 0.50 | M-64 | 0.50 | | | | |
| E-33 | M-50 | 0.20 | M-3 | 0.80 | | | | |
| E-34 | M-50 | 0.30 | M-1 | 0.10 | M-3 | 0.60 | | |
| E-35 | M-50 | 0.20 | M-1 | 0.20 | M-5 | 0.60 | | |
| E-36 | M-50 | 0.30 | M-43 | 0.70 | | | | |
| E-37 | M-16 | 1.0 | | | | | | |
| E-38 | M-31 | 0.55 | M-64 | 0.40 | M-1 | 0.05 | | |
| E-39 | M-53 | 0.80 | M-2 | 0.10 | M-1 | 0.10 | | |
| M-40 | M-3 | 0.90 | M-20 | 0.10 | | | | |

Further, the polymer latex, includes those described in U.S. Pat. Nos. 3,986,877, 3,516,830 and 3,533,793, *Research Disclosure,* 15469 (February, 1977), U.S. Pat. Nos. 3,635,713, 3,397,988, 3,647,459, 3,607,290, 3,512,985, 3.,536,491, 3,769,020, 3,764,327, 2,376,005, 2,768,080, 2,772,166, 2,808,388, 2,835,582, 2,852,386, 2,853,457 and 2,865,753, U.K. Patents Nos. 1,358,885 and 1,186,699, U.S. Pat. Nos. 3,592,655, 3,411,911, 3,411,912, 3,459,790, 3,488,708, 3,700,456, 3,939,130, 3,554,987, 3,507,661 and 3,508,925, U.K. Patents Nos. 1,316,541, 1,336,061, 1,491,701 and 1,498,697, *Research Disclosure,* 14739 (July, 1976), U.S. Pat. No. 3,620,751, 14739 (July, 1976), U.S. Pat. No. 3,620,751, *Research Disclosure,* 15638 (DATE), U.S. Pat. No. 3,635,715, U.K. Patent No. 1,401,768, U.S. Pat. Nos. 3,967,966, 3,142,568, 3,252,801, 3,625,689, 3,632,342 and 2,887,380, U.K. Patent No. 1,623,522, U.S. Pat. Nos. 2,721,801, 2,876,054 and 3,021,214, 3,793,029, and *Research Disclosure,* Nos. 15235 (December, 1976), 11906 (March, 1974) and 16250 (October, 1977).

The polymer latex for the hydrophilic colloid layers of the present invention can be incorporated in at least one hydrophilic colloid layer such as a silver halide emulsion layer, backing layer, protective layer, or intermediate layer.

The polymer latexes used in the present invention are water dispersions of water-insoluble polymers having an average particle diameter of 20 to 200 mμ and are used in a weight ratio of the latex to gelatin as the binder of 0.01–1.0:1.0, preferably 0.1–0.8:1.0 on a dry basis.

The present invention has a remarkable effect in super-high-contrast photographic materials containing hydrazine derivatives. The super-high-contrast photographic materials containing hydrazine derivatives and image forming methods using the same are .described in U.S. Pat. Nos. 4,224,401, 4,168,977, 4,166,742, 4,241,164 and 4,272,606, Nos. JP-A-60-83028, JP-A-60-218642, JP A-60-258537 and No. JP-A-61-223738. The hydrazine derivatives may be incorporated into a silver halide emulsion layer of the photographic materials.

Preferred hydrazine derivatives which are used in the present invention are compounds represented by the following general formula (Q),

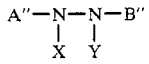

(Q)

wherein A″ represents an aliphatic group or an aromatic group; B″ represents a formyl group, an acyl group, an alkyl or arylsulfonyl group, an alkyl or arylsulfinyl group, a carbamoyl group, an alkoxy or aryloxycarbonyl group, a sulfinamoyl group, an alkoxysulfonyl group, a thoacyl group, sulfanilyl group or a heterocyclic group; and both X and Y represent hydrogen or one of X and Y represents hydrogen and the other represents a substituted or unsubstituted alkyl sulfonyl group, a substituted or unsubstituted arylsulfonyl group or a substituted or unsubstituted acyl group.

Typical examples of the compounds represented by formula (Q) include the following compounds

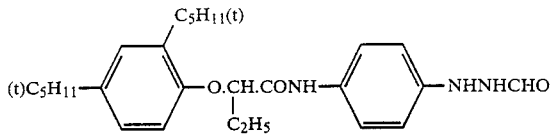

(Q-1)

-continued (Q-2)

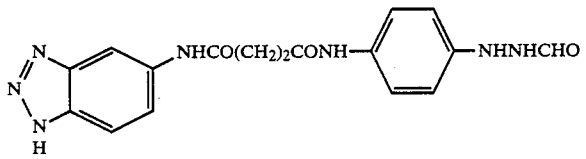

(Q-3)

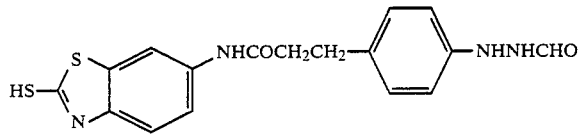

(Q-4)

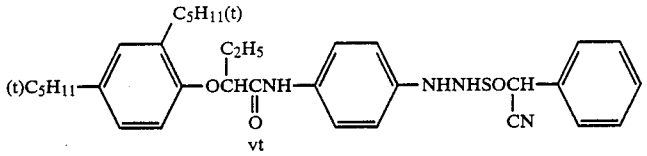

(Q-5)

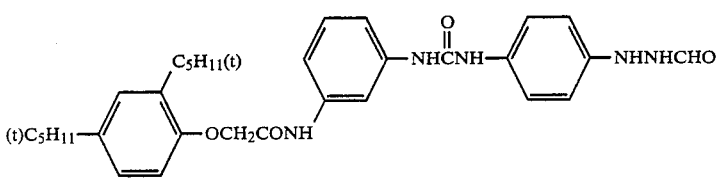

(Q-6)

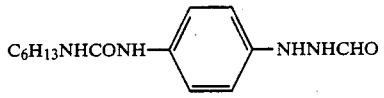

(Q-7)

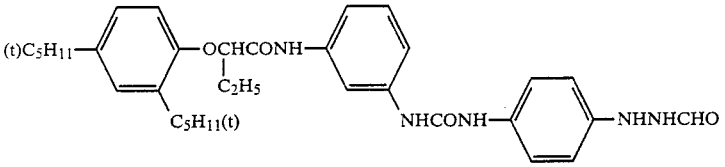

(Q-8)

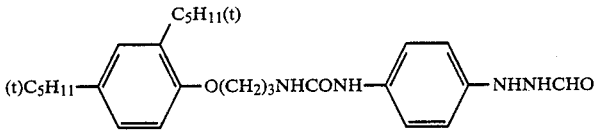

The synthesis of the hydrazine derivataives used in the present invention is disclosed in Research Disclosure Item 23516 (November 1983, page 346) and publications disclosed therein, U.S. Pat. Nos. 4,080,207, 4,269,929, 4,276,364, 4,278,748, 4,385,108, 4,459,347, 4,560,638, 4,478,928, and 4,686,167, British Patent No. 2,011,391B, etc.

Further, the present invention is effective, when the present invention is applied to methods for obtaining high contrast by processing photographic materials containing tetrazolium compounds with PQ type or MQ type developing solutions having a relatively high sulfite content. Image forming methods using tetrazolium compounds are described in Nos. JP-A-52-18317, JP-A-52-17719 and No. JP-A-53-17720.

Silver halide emulsions for the photographic materials of the present invention can be prepared by mixing a solution of a water-soluble silver salt (e.g., silver nitrate) with a solution of a water-soluble halogen salt (e.g., potassium bromide) in the presence of a solution of a water-soluble high-molecular binder such as gelatin.

Any of silver halides such as silver chloride, silver bromide, silver chlorobromide, silver iodobromide and silver chloroiodobromide can be used without particular limitation with regard to grain shape and grain distribution.

The silver halide emulsion layers may contain light-sensitive silver halide, chemical sensitizing agents, spectral sensitizing agents, anti-fogging agents, hydrophilic colloids (particularly gelatin), curing agents for gelatin, and agents for improving the physical properties of the film such as surfactant and thickener. The emulsion layers are described in more detail in *Research Disclosure*, Vol. 176, Item 17643 (December 12, 1978), Nos. JP-A-52-108130, JP-A-52-114328, JP-A-52-121321, JP-A-53-3217 and JP-A-53-44025.

Preferred surfactants used in the present invention are polyalkylene oxides having a molecular weight of not less than 600 described in JP-B-58-9412.

The surface protective layer is a layer having a thickness of 0.3 to 3 μm, preferably 0.5 to 1.5 μm and containing a hydrophilic colloid such as gelatin as a binder. The protective .layer contains a matting agent such as fine particles of polymethyl methacrylate, colloidal silica, an optional thickener such as potassium polystyrenesulfonate, a curing agent for gelatin, a surfactant, a lubricant, or an ultraviolet light absorber.

Examples of curing agents for gelatin include chromium salts, aldehydes (e.g., formaldehyde, glutaraldehyde), N-methylol compounds (e.g., dimethylol urea), active vinyl compounds (e.g., 1,3,5-triacryloyl- hexahydro-s-triazine, bis(vinylsulfonyl)methyl ether, N,N'-methylenebis-[8-(vinylsulfonyl)propionamide]), active halogen compounds (e.g., 2,4-dichloro-6-hydroxy- s-triazine), mucohalogenic acids (e.g., mucochloric acid), N-carbamoylpyridinium salts (e.g., (1-morpholinocarbonyl-3-pyridinio) methane-sulfonate), haloamidinium salts (e.g., 1-(1-chloro-1-pyridinomethylene)pyrrolidinium-2-naphthalenesulfonate) and mixtures thereof. Among them, there are preferred active vinyl compounds described in Nos. JP-A-53-41220, JP-A-53-57257, JP-A-59-162546 and JP-A-60-80846 and active halides described in U.S. Pat. No. 3,325,287.

The backing layer is a layer which contains a hydrophilic colloid such as gelatin and is non-lightsensitive sensitive. The backing layer may be composed of a single layer structure of a multi-layer structure having an intermediate layer, or a protective layer.

The backing layer has a thickness of 0.1 to 10 μm and may optionally contain a curing agent for gelatin, surfactant, matting agent, colloidal silica, lubricant, UV absorber, dye, thickener, as in the silver halide emulsion layers and the protective layer.

The method of the present invention can be applied to various photographic materials having hydrophilic colloid layers. Typically, the present invention can be applied to photographic materials using silver halides as sensitive components such as printing photographic materials, X-ray photographic materials, general-purpose negative photographic materials, general-purpose reversal photographic materials, general-purpose photographic materials and direct positive photographic materials. Among them, the invention is particularly effective, when it is applied to printing photographic materials.

The photographic materials of the present invention can be exposed and developed as described in Nos. JP-A-52-108130, JP-A-52-114328, JP-A-52-121321 and *Research Disclosure* without particular limitation with regard to exposure method and development method.

In the present invention, a hydrophilic colloid layer containing a polymer latex is provided on at least one side of the polyester support and both sides of the support are coated with a vinylidene chloride copolymer latex composed of a core-shell type latex, to obtain a silver halide photographic material having excellent dimensional stability against environmental change and processing.

Further, the silver halide photographic materials have excellent adhesion between the vinylidene copolymer layer and the support and particularly excellent adhesion between the vinylidene chloride polymer layer and a binder layer adjacent thereto, because a monomer having a group capable of linking to the binder directly or through the hardening agent is present in the vinylidene chloride copolymer.

The present invention is now illustrated in greater detail with reference to the following specific examples which, are not to be construed as limiting the present invention in any way. Unless otherwise indicated, all part, percent and ratios are by weight.

EXAMPLE 1

Four semicircular bar electrodes having a length of 40 cm and a cross section of 3 cm in diameter at 10 cm intervals were fixed to an insulating sheet. The sheet provided with the electrodes was fixed in a vacuum tank. A biaxially oriented polyethylene terephthalate film having a thickness of 100 μm and a width of 30 cm was passed at a rate of 20 m/min by a bar which was 15 cm away from the electrode surface and opposed to the electrode surface. A heated roll having a diameter of 50 cm, provided with a temperature controller was set to 100° C. and so arranged that the film was brought into contact with 3/4 rounds of the roll just before the film was passed over the electrodes. Glow discharge was conducted by applying a voltage of 2000 V to the electrodes while keeping the pressure within the tank at 0.1 Torr. The electrode current was 0.5 A. Hence, the PET support was treated at a rate of 0.125 KVA.min/$m^2$. Both sides of the thus glow discharge-treated polyethylene terephthalate were coated with an aqueous dispersion of a vinylidene chloride copolymer containing 2,6-dichloro-6-hydroxy-1,3,5-triazine sodium salt in an amount of 3 wt % based on polymer weight given in Table 1 and dried at 120° C.

Further, both sides of the first undercoat layer composed of the vinylidene chloride copolymer were coated with an undercoating solution having the following formulation (1) in an amount of 20 ml/$m^2$ to provide a second undercoat layer. The coated support was dried at 170° C.

One side of the support was then coated with a silver halide emulsion layer having the following formulation (2). Further, an emulsion-protective layer having the following formulation (3) was coated thereon. The other side of the support was coated with a backing layer having the following formulation (4) and then a backing-protective layer having the following formulation (5) to obtain each of Samples 1 to 7. A sample 8 was prepared by coating the glow dischargetreated polyethylene terephthalate directly with the second undercoat layer.

(1) Formulation of the second undercoat layer

| Ingredient | Parts by Weight |
|---|---|
| Gelatin | 1.0 |
| Reaction product of epichlorohydrin with a polyamide composed of diethylenetriamine and adipic acid | 0.07 |
| Saponin | 0.01 |
| Add water | 100 |

(2) Formulation of the silver halide emulsion

An aqueous solution of silver nitrate and an aqueous solution of a mixture of sodium chloride and potassium bromide were simultaneously added to an aqueous gelatin solution kept at 50° C. in the presence of $2\times10^{-5}$ mol (per mol of silver) of rhodium chloride at a given rate over a period of 30 minutes to prepare a monodisperse silver chlorobromide emulsion having a mean grain size of 0.2 μm (Cl composition: 95 mol %)

The emulsion was desalted by a flocculation method. 1 mg of thiourea dioxide and 0.6 mg of chloroauric acid were added thereto, each amount being per mol of silver. Ripening was conducted at 65° C. until the maximum performance was obtained to cause fogging.

To the thus-obtained emulsion, there were added the following compounds.

| | |
|---|---|
| 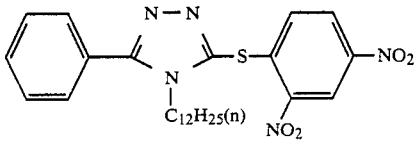 | $2 \times 10^{-2}$ mol/mol of Ag |
| 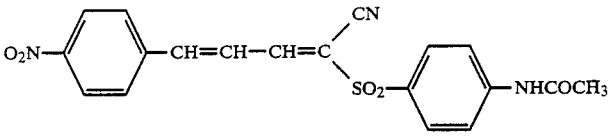 | $1 \times 10^{-3}$ mol/mol of Ag |
| KBr | 20 mg/m$^2$ |
| 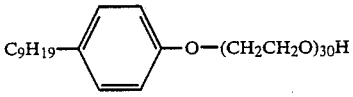 | $4 \times 10^{-4}$ mol/mol of Ag |
| Sodium salt of polystyrene sulfonic acid | 40 mg/m$^2$ |
| Sodium salt of 2,6-dichloro-6-hydroxy-1,3,5-triazine | 30 mg/m$^2$ |

This coating solution was coated in an amount providing a coating weight of 3.5 g/m$^2$ in terms of silver.

(3) Formulation of the emulsion-protective layer

| | |
|---|---|
| Gelatin | 1.5 g/m$^2$ |
| Fine $SiO_2$ particle (mean grain size: 4 μm) | 50 mg/m$^2$ |
| Sodium dodecylbenzenesulfonate | 50 mg/m$^2$ |
| 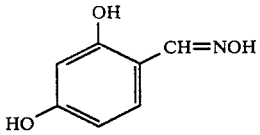 | 20 mg/m$^2$ |
| 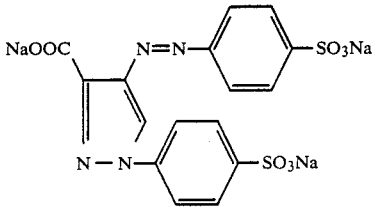 | 100 mg/m$^2$ |

(4) Formulation of the backing layer

| | |
|---|---|
| Gelatin | 2.5 g/m$^2$ |
| 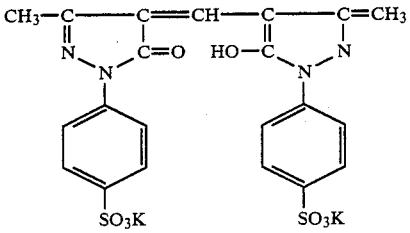 | 30 mg/m$^2$ |
| 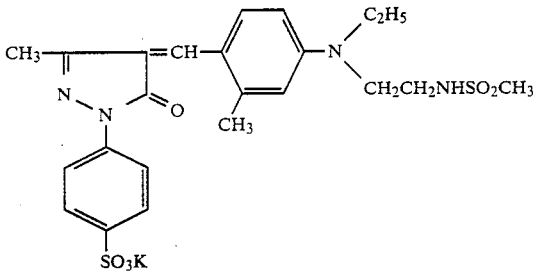 | 140 mg/m$^2$ |

-continued

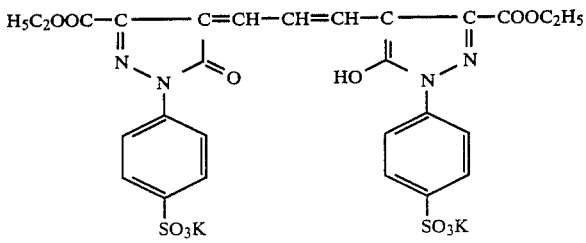

40 mg/m²

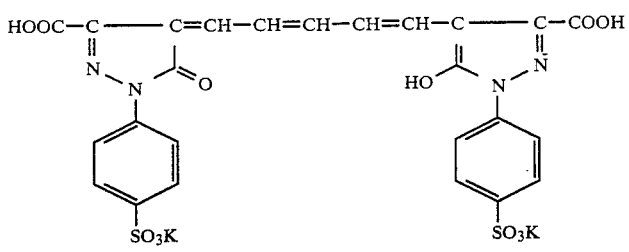

80 mg/m²

| | |
|---|---|
| 1,3-Divinylsulfonyl-2-propanol | 150 g/m² |
| Ethylacrylate latex (mean grain size: 0.1 μm) | 900 g/m² |
| Dihexyl sodium α-sulfosuccinate | 35 g/m² |
| Sodium dodecylbenzenesulfonate | 35 g/m² |

(5) Formulation of the backing-protective layer

| | |
|---|---|
| Gelatin | 0.8 g/m² |
| Fine particles of polymethyl methacrylate (mean grain size: 3 μm) | 20 g/m² |
| Dihexyl sodium α-sulfosuccinate | 10 g/m² |
| Sodium dodecylbenzenesulfonate | 10 g/m² |
| Sodium acetate | 40 g/m² |

The sample was left to stand at 25° C. in an atmosphere at an RH of 50% for two weeks. The change in dimensions caused by development was measured in the following manner.

(6) Evaluation of change in dimension caused by development

Two holes 8 mm in diameter at 200 mm intervals were made in the sample. After the sample was left to stand in a room at 25° C. and RH of 30% for two hours, the space between the two holes was accurately measured by a pin gauge (accuracy: 1/1000 mm). The measured length was referred to as X mm. The sample was developed by using an automatic processor, fixed, washed with water and dried. After 5 minutes, the space was measured. The measured value was referred to as Y mm. The rate (%) of change in dimension caused by processing was evaluated by the following formula $$\frac{Y - X}{200} \times 100$$

When the rate of change in dimension is within ±0.01%, it is considered by those skilled in the art that there are practically no problems.

The development was conducted by an automatic processor (FG-660, manufactured by Fuji Photo Film Co., Ltd.). The developing solution used was GRD-1 (Fuji Photo Film Co., Ltd.), the fixing solution was GRF-1 (Fuji Photo Film Co., Ltd.) and processing was conducted at 38° C. for 20 seconds. The drying temperature was 45° C.

The samples 1 to 8 were subjected to adhesion tests. The term "adhesion" as used herein refers to adhesion between the support and the emulsion layer and between the support and the back layer. Tests were conducted in the following manner.

1. Test method for adhesion of dry film 36 cells were made on the surface of the emulsion layer to be tested by making 7 cuts at 5 mm intervals lengthwise and crosswise, respectively. A pressure-sensitive adhesive tape (e.g., Nitto tape, a product of Nitto Electric Industrial Co., Ltd.) was adhered thereto and quickly peeled off at an angle of 180 degrees. Evaluation was made in three grades. When the ratio of the area not peeled off was 90% or more, the evaluation was class A. The ratio of 60% or more was evaluated as class B and the ratio of less than 60% was evaluated as class C. Photographic materials having a bond strength capable of withstanding practical use, belong to class A.

2. Test method for adhesion of wet film

Scratch marks x were made on the surface of the emulsion layer of the film with a pencil in a processing solution in each stage of development, fixing and water washing. The surface was vigorously rubbed with the finger tip five times. Adhesion was evaluated by the maximum peeled width peeled off along the line of marks x.

Evaluation was made in three grades. When the peeled area of the emulsion layer was not larger than the scratch mark, the evaluation was class A. When the maximum peeled width was within 5 mm, the evaluation was class B. Other cases were judged to be class C. Photographic materials having a bond strength capable of withstanding practical use, are those belonging to at least class B, preferably class A.

3. Shear stability of polymer

The shear stability of the polymer was evaluated by using a Marron type measuring device. 100 cc of a 15 wt % dispersion of a polymer was kept at 15° C. and tested for 15 minutes while applying a load of 10 kg. The formed agglomerate was collected and dried. The weight of the agglomerate was measured. When the weight of the agglomerate was not more than 5 mg, shear stability was judged to be good.

4. Surface profile of vinylidene chloride copolymer-coated film

Before the silver halide emulsion was coated, the undercoated support was dyed by immersing it in a 1% aqueous solution of Brilliant Blue. Dyeability was visually evaluated.

TABLE 1

| | First undercoat layer | | Ratio of | | | |
|---|---|---|---|---|---|---|
| | Vinylidene chloride copolymer | Dry film thickness (μm) | change in dimension (%) | Adhesion Dry film | Adhesion Wet film | Surface profile of coat |
| 1 | Compound 1 | 0.2 | 0.015 | A | A | good*1 |
| 2 (Invention) | " | 0.3 | 0.010 | A | A | " |
| 3 | " | 0.5 | 0.007 | A | A | " |
| 4 | Compound 2 | 0.5 | 0.008 | A | A | " |
| 5 | Compound 3 | " | 0.007 | A | A | " |
| 6 | Compound 5 | " | 0.007 | A | A | " |
| 7 | Compound 9 | " | 0.008 | A | A | " |
| 8 | Compound 19 | " | 0.008 | A | A | " |
| 9 | Comp. Compound 101 | " | 0.015 | B | C | bad*2 |
| 10 | Comp. Compound 102 | " | 0.016 | B | B | good |
| 11 | Comp. Compound 103 | " | 0.015 | A | B | bad |
| 12 | Comp. Compound 104 | " | 0.018 | B | C | bad |

*1uniformly dyed
*2non-uniformly dyed

It is apparent from Table 1 that the samples 2 to 8 using the compounds of the invention were improved in dimensional stability, adhesion of dry and wet films and coated surface profile as compared with the comparative samples 9 to 12. Sample 1 exhibited a problem in dimensional stability, even when the compound of the invention was used, because the coated film was thick.

TABLE 1'

| | First undercoat layer | | Ratio of | | | Shear stability | |
|---|---|---|---|---|---|---|---|
| | Vinylidene chloride copolymer | Dry film thickness (μm) | change in dimension (%) | Adhesion Dry film | Adhesion Wet film | (amount of agglomerate) (mg) | Surface profile of coat |
| 1 | Compound 1 | 0.2 | 0.015 | A | A | 3 | good*1 |
| 2 (Invention) | " | 0.3 | 0.010 | A | A | " | " |
| 3 (Invention) | " | 0.5 | 0.007 | A | A | " | " |
| 4' (Invention) | Compound 2' | 0.5 | 0.010 | A | A | 2 | " |
| 5' (Invention) | Compound 3' | 0.5 | 0.007 | A | A | 3 | " |
| 6' (Invention) | Compound 4' | 0.5 | 0.007 | A | A | 2 | " |
| 7' (Invention) | Compound 8' | 0.5 | 0.007 | A | A | 3 | " |
| 8' (Invention) | Compound 10' | 0.5 | 0.007 | A | A | 10 | " |
| 9' (Invention) | Compound 11' | 0.5 | 0.007 | A | A | 2 | " |
| 10' (Invention) | Compound 12' | 0.5 | 0.007 | A | A | 3 | " |
| 11' (Comparison) | Comp. compound 102' | 0.5 | 0.008 | B | C | 50 | bad*2 |
| 12' (Comparison) | Comp. compound 102' | 0.5 | 0.011 | B | C | 45 | bad |
| 13' (Comparison) | Comp. compound 103' | 0.5 | 0.014 | B | C | 50 | bad |
| 14' (Comparison) | Comp. compound 104' | 0.5 | 0.016 | A | B | 8 | good |

EXAMPLE 2

Both sides of a polyethylene terephthalate film which were glow discharge-treated in the same way as in Example 1, were coated with an aqueous dispersion of a vinylidne chloride copolymer given in Table 2. The coated support was dried at 120° C.

Both sides of the coated support were coated with the second undercoat layer in the same way as in Example 1 and dried at 150° C.

One side of the resulting support was coated with a silver halide emulsion layer (1) and an emulsionprotective layer (2). The other side thereof was coated with a backing layer (3) and then a backing-protective layer (4) to prepare each of Samples 1 to 5.

(1) Formulation of silver halide emulsion layer

An emulsion A was prepared in the following manner by using the following solutions I, II and III.

Solution I: 300 ml of water, 9 g of gelatin

Solution II: 100 g of $AgNO_3$, 400 ml of water

Solution III: 37 g of NaCl, 0.66 mg of $(NH_4)_3RhCl_6$, 400 ml of water

The solutions II and III were simultaneously added to the solution I kept at 40° C. at a given rate. After soluble salts were removed from the emulsion by a conventional method, gelatin was added. Further, 6-methyl-4-hydroxy-1,3,3*a*,7-tetraazaindene and 4-hydroxy-5,6-trimethylene-1,3,3*a*,7-tetraazaindene were added as stabilizers thereto. The emulsion was a monodisperse emulsion having a mean grain size of 0.15 μm. The amount of gelatin contained therein was 60 g per 1 kg of the emulsion.

To the thus-obtained emulsion were added the following compounds:

| | |
|---|---|
| 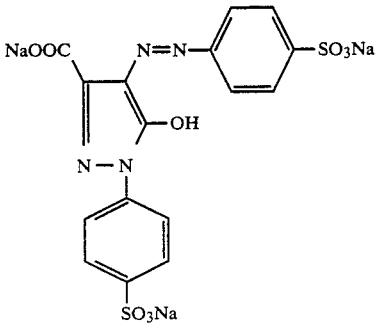 | 5 mg/m$^2$ |
| Sodium salt of polystyrenesulfonic acid | 10 mg/m$^2$ |
| 1,2-Bis(vinylsulfonylacetamide)ethane | 100 mg/m$^2$ |
| Ethyl acrylate latex (mean grain size: 0.1 μm) | 500 mg/m$^2$ |
| 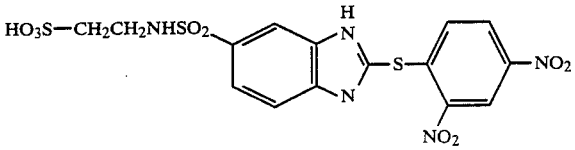 | 0.3 mg/m$^2$ |

The thus-obtained coating solution was coated in an amount to give a coating weight of 3 g/m$^2$ in terms of silver.

(2) Formulation of emulsion-protective layer

| | |
|---|---|
| Gelatin | 1.5 g/m$^2$ |
| Fine particle of polymethyl methacrylate (mean grain size: 3 μm) | 50 mg/m$^2$ |
| 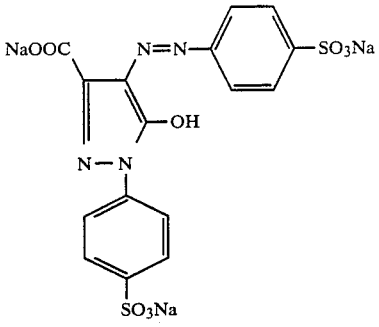 | 5 mg/g$^2$ |

-continued

| | |
|---|---|
| Sodium dodecylbenzenesulfonate | 25 mg/m$^2$ |
| Dihexyl sodium α-sulfosuccinate | 10 mg/m$^2$ |
| Potassium salt of N-perfluoro octanesulfonyl-N-propylglycine | 2 mg/m$^2$ |
| Sodium salt of polystyrenesulfonic acid | 3 mg/m$^2$ |
| Ethyl acrylate latex (mean grain size: 0.1 μm) | 200 mg/m$^2$ |
| Colloidal silica | 350 mg/m$^2$ |
| Lipoic acid | 8 mg/m$^2$ |

(3) Formulation of backing layer

| | |
|---|---|
| Gelatin | 2 g/m$^2$ |
| 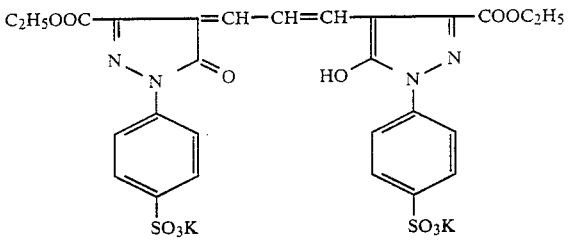 | 30 mg/m$^2$ |

-continued

| | |
|---|---|
| 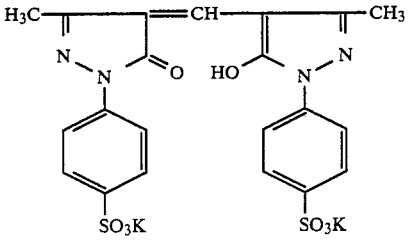 | 180 mg/m$^2$ |
| 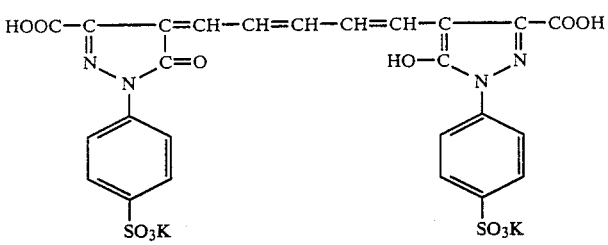 | 50 mg/m$^2$ |
| Dihexyl sodium α-sulfosuccinate | 20 mg/m$^2$ |
| Sodium dodecylbenzenesulfonate | 30 mg/m$^2$ |
| Sodium salt of polystyrenesulfonic acid | 30 mg/m$^2$ |
| 1,3-Divinylsulfonyl-2-propanol | 100 mg/m$^2$ |
| Ethyl acrylate latex (mean grain size: 0.1 μm) | 200 mg/m$^2$ |

(4) Formulation of backing-protective layer

| | |
|---|---|
| Gelatin | 1 g/m$^2$ |
| Fine particle of polymethyl methacrylate (mean grain size: 3 μm) | 40 mg/m$^2$ |
| Dihexyl sodium sulfosuccinate | 10 mg/m$^2$ |
| Sodium dodecylbenzenesulfonate | 30 mg/m$^2$ |
| Sodium salt of polystyrenesulfonic acid | 25 mg/m$^2$ |
| Sodium acetate | 30 mg/m$^2$ |

TABLE 2

| | First undercoat layer | | Ratio of change in dimension (%) | Adhesion | |
|---|---|---|---|---|---|
| | Vinylidene chloride copolymer | Dry film thickness (μm) | | Dry film | Wet film |
| 1 (Invention) | Compound 1 | 0.3 | 0.010 | A | A |
| 2 (Invention) | " | 0.5 | 0.008 | A | A |
| 3 (Invention) | " | 1.0 | 0.006 | A | A |
| 4 (Comparative) | Comparative compound 102 | 0.5 | 0.016 | B | C |
| 5 (Comparative) | Comparative compound 102 | 1.0 | 0.010 | B | C |

The samples 1 to 3 using the compounds of the invention were satisfactory with respect to the ratio of change in dimension and adhesiveness, while samples 4 and 5 using comparative compounds were inferior in the adhesion of wet film and could not be put to practical use, though the ratio of change in dimension reached a practical level.

TABLE 2'

| | First undercoat layer | | Ratio of change in dimension (%) | Adhesion | |
|---|---|---|---|---|---|
| | Vinylidene chloride copolymer | Dry film thickness (μm) | | Dry film | Wet film |
| 1 (Invention) | Compound 1 | 0.3 | 0.010 | A | A |
| 2 (Invention) | " | 0.5 | 0.008 | A | A |
| 3 (Invention) | " | 1.0 | 0.006 | A | A |
| 4' (Comparative) | Comparative compound 102' | 0.5 | 0.011 | B | C |
| 5' (Comparative) | Comparative compound 102' | 1.0 | 0.007 | B | C |

The samples 1 to 3 using the compounds of the invention were satisfactory with regard to the ratio of change in dimension as well as adhesion, while the comparative samples 4' and 5' were inferior in the adhesion of wet film and could not be put to practical use, though the ratio of change in dimension reached a practical level.

EXAMPLE 3

Both sides of a corona discharge-treated polyethylene terephthalate film were coated with a solution obtained by adding 3% (based on the weight of polymer) of the sodium salt of 2,6-dichloro-6-hydroxy-1,3,5triazine to Poysol (a product of Showa Highpolymer Co., Ltd.), in such an amount as to give a dry film of 0.3 μm in thickness. The coated support was dried at 150° C. Both sides of the coated support were coated with an aqueous dispersion of a vinylidene chloride copolymer, as first undercoat layer, given in Table 3 and dried at 120° C. In the same way as in Example 1, both sides thereof were then coated with the second undercoat layer and dried at 170° C. One side of the resulting support was coated with the following silver halide emulsion layers 1 and 2 and the following protective layers 1 and in this order, and dried. The other side of the support was coated with the following backing layer and protective layer 3 and dried to prepare each of Samples 1 to 3 and 7 to 9. In a similar manner to that described above, one side of the corona discharge-treated polyethylene terephthalate film was coated with the first undercoat layer, the second undercoat layer, the silver halide emulsion layers 1 and 2 and the protective layers 1 and 2 without using Polysol. Other side thereof was coated with the back layer and protective layer 3 to prepare each of Samples 4 to 6.

(1) Formulation of silver halide emulsion layer 1

Solution I: Water 300 ml, gelatin 9 g

Solution II: $AgNO_3$ 100 g, water 400 ml

Solution III: NaCl 37 g, $(NH_4)_3RhCl_6$ 1.1 mg, water 400 ml

The solutions II and IIIA were simultaneously added to the solution I kept at 45° C. at a given rate. After soluble salts were removed from the resulting emulsion by a conventional method, gelatin was added thereto. Further, 6-methyl-4-hydroxy-1,3,3a,7-tetraazaindene as a stabilizer was added thereto. The resulting emulsion was a monodisperse emulsion having a mean grain size of 0.20 μm. The amount of gelatin was 60 g per 1 kg of the yield of the emulsion.

To the thus-obtained emulsion were added the following compounds.

(Q-8) $5 \times 10^{-3}$ mol/mol of Ag

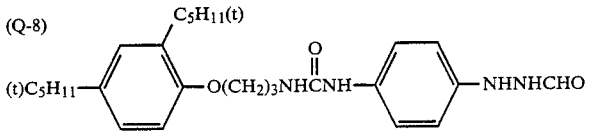

(Compound-a) 60 mg/m²

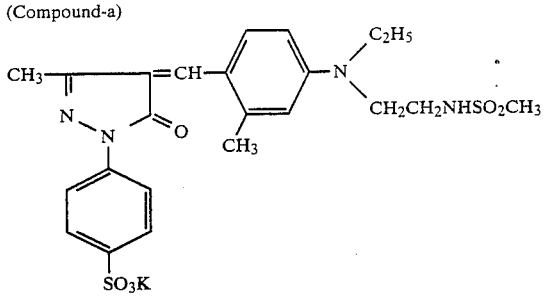

(Compound-b) 9 mg/m²

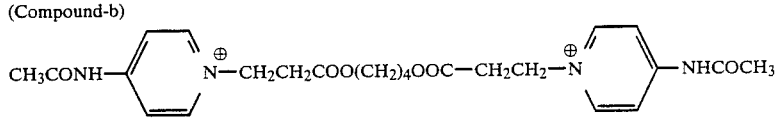

| | |
|---|---|
| Sodium salt of polystyrenesulfonic acid | 40 mg/m² |
| Sodium salt of N-oleoyl-N-methyltaurine | 50 mg/m² |
| 1,2-Bis(vinylsulfonylacetamide)ethane | 70 mg/m² |
| 1-Phenyl-5-mercaptotetrazole | 3 mg/m² |
| Ethyl acrylate latex (mean grain size: 0.1 μm) | 40 mg/m² |

The thus-obtained coating solution was coated in such an amount to give a coating weight of 2 g/m² in terms of silver.

(2) Formulation of silver halide emulsion layer 2

Solution I: Water 300 ml, gelatin 9 g

Solution II: $AgNO_3$ 100 g, water 400 ml

Solution IIIB: NaCl 37 g, $(NH_4)_3RhCl_6$ 2.2 mg, water 400 ml

The preparation was repeated in the same manner as in the emulsion A except that the solution IIIB was used in place of the solution IIIA to prepare the emulsion B. The emulsion was a monodisperse emulsion having a mean grain size of 0.20 μm.

To the thus-obtained emulsion B were added the following compounds.

| | |
|---|---|
| Compound Q-8 | $5 \times 10^{-3}$ mol/mol of Ag |
| Compound (a) | 60 mg/m² |
| Compound (b) | 9 mg/m² |
| Sodium salt of polystyrenesulfonic acid | 50 mg/m² |
| Sodium salt of N-oleoyl-N-methyltaurine | 40 mg/m² |
| 1,2-Bis(vinylsulfonylacetamide)ethane | 85 mg/m² |
| 1-Phenyl-5-mercaptotetrazole | 3 mg/m² |
| Ethyl acrylate latex (mean grain size: 0.1 μm) | 40 mg/m² |

The thus-obtained emulsion was coated in such an amount as to give a coating weight of 2 g/m² in terms of silver.

(3) Formulation of protective layer 1

| | |
|---|---|
| Gelatin | 1.0 g/m$^2$ |
| Lipoic acid | 5 mg/m$^2$ |
| Sodium dodecylbenzenesulfonate | 5 mg/m$^2$ |
| Compound (c) | 20 mg/m$^2$ |
| Sodium salt of polystyrenesulfonic acid | 10 mg/m$^2$ |
| Compound (c) | 20 mg/m$^2$ |

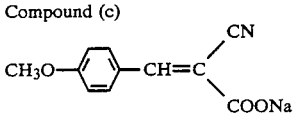

(4) Formulation of protective layer

| | |
|---|---|
| Gelatin | 1.0 g/m$^2$ |
| Fine particle of polymethyl methacrylate (average particle size: 3 μm) | 60 mg/m$^2$ |
| Sodium dodecylbenzenesulfonate | 20 mg/m$^2$ |
| Potassium salt of N-perfluoro-octanesulfonyl-N-propylglycine | 3 mg/m$^2$ |
| Sulfuric ester sodium salt of poly (degree of polymerization: 5) oxyethylene nonylphenol ester | 20 mg/m$^2$ |
| Sodium salt of polystyrenesulfonic acid | 2 mg/m$^2$ |

(5) Formulation of backing layer

| | |
|---|---|
| Gelatin | 2.5 g/m$^2$ |
| 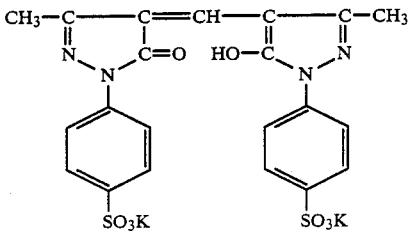 | 300 mg/m$^2$ |
| 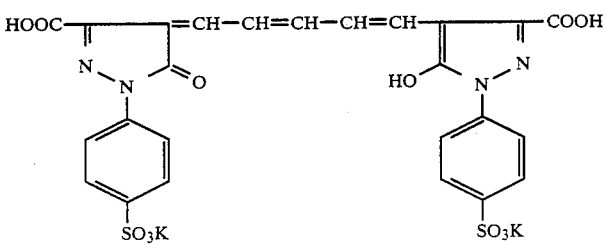 | 50 mg/m$^2$ |
| 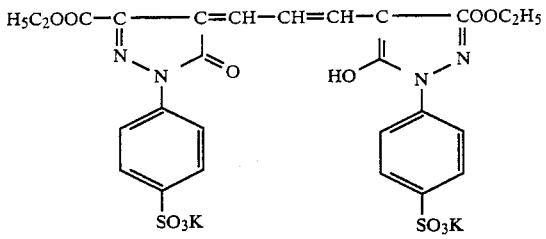 | 50 mg/m$^2$ |
| Sodium dodecylbenzenesulfonate | 50 mg/m$^2$ |
| Dihexyl sodium α-sulfosuccinate | 20 mg/m$^2$ |
| Sodium salt of polystyrenesulfonic acid | 40 mg/m$^2$ |
| 1,3-Divinylsulfonyl-2-propanol | 150 mg/m$^2$ |
| Ethyl acrylate latex (mean grain size: 0.1 μm) | 500 mg/m$^2$ |

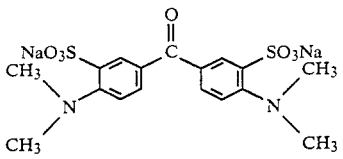

| | |
|---|---|
| Ethyl acrylate latex (mean grain size: 0.1 μm) | 200 mg/m$^2$ |

(6) Formulation of protective layer (protective layer for back layer)

| | |
|---|---|
| Gelatin | 1.0 g/m$^2$ |
| Fine particles of polymethyl methacrylate (average particle size: 3 μm) | 40 mg/m$^2$ |
| Sodium dodecylbenzenesulfonate | 15 mg/m$^2$ |
| Dihexyl sodium α-sulfosuccinate | 10 mg/m$^2$ |
| Sodium salt of polystyrenesulfonic acid | 20 mg/m$^2$ |
| Sodium acetate | 40 mg/m$^2$ |

TABLE 3

| | First undercoat layer | | Ratio of | Adhesion | |
|---|---|---|---|---|---|
| | Vinylidene chloride copolymer | Dry film thickness (μm) | change in dimension (%) | Dry film | Wet film |
| 1 (Invention) | Compound 3 | 0.5 | 0.008 | A | A |
| 2 (Invention) | " | 1.5 | 0.006 | A | A |
| 3 (Invention) | " | 2.5 | 0.004 | A | A |
| 4 (Invention) | " | 0.5 | 0.008 | A | A |
| 5 (Invention) | " | 1.5 | 0.006 | A | A |
| 6 (Invention) | " | 2.5 | 0.004 | B | B |
| 7 (Comparative) | Comparative compound 103 | 0.5 | 0.014 | B | C |
| 8 (Comparative) | Comparative compound 103 | 1.5 | 0.010 | B | C |
| 9 (Comparative) | Comparative compound 103 | 2.5 | 0.008 | C | C |

TABLE 3'

| | First undercoat layer | | Ratio of | Adhesion | |
|---|---|---|---|---|---|
| | Vinylidene chloride copolymer | Dry film thickness (μm) | change in dimension (%) | Dry film | Wet film |
| 1' (Invention) | Compound 2' | 0.5 | 0.008 | A | A |
| 2' (Invention) | " | 1.5 | 0.006 | A | A |
| 3' (Invention) | " | 2.5 | 0.004 | A | A |
| 4' (Invention) | " | 0.5 | 0.008 | A | A |
| 5' (Invention) | " | 1.5 | 0.006 | A | A |
| 6' (Invention) | " | 2.5 | 0.004 | B | B |
| 7' (Comparative) | Comparative compound 103' | 0.5 | 0.014 | B | C |
| 8' (Comparative) | Comparative compound 103' | 1.5 | 0.010 | B | C |
| 9' (Comparative) | Comparative compound 103' | 2.5 | 0.008 | C | C |

It is apparent that samples 4 to 6 and 4' to 6' using the compounds of the invention were superior to comparative samples 7 to 9 and 7' to 9' in adhesion, even though the thickness of the first undercoat layer was the same. However, even when the compounds of the invention were used, adhesion was reduced with an increase in the thickness of the first undercoat layer, even though it is considered that they could be practically used (Samples 6 and 6'). Adhesion was improved when the polysol layer was provided between the corona discharge-treated polyethylene terephthalate and the first undercoat layer.

EXAMPLE 4

One side of the support having the second undercoat composition 1 among the undercoated supports of Example 1 of No. JP-A-60-26944 was coated with the silver halide emulsion layer and then the protective layer described in Example 1 and dried under conditions given in Table 4. The other side thereof was coated with the backing layer and the protective layer described in Example 1 and dried under conditions given in Table 4.

These samples were cut into chips having a size of 25 cm×30 cm and packed into moistureproof bags under conditions given in Table 4. The moistureproof bag was article 8 described in Example 1 of No. JP-A-61-189936.

The samples hermetically sealed in the moistureproof bags were left to stand at 25° C. for two weeks and the ratio of change in dimension caused by development was measured by the method described in Example 1. The results are shown in Table 4.

TABLE 4

| Sample No. | Drying conditions: Drying time (sec.) | Temperature (water: 300% or more) (°C.) | Temperature & humidity (water: 300% or less) | Ratio of change in dimension (%) |
|---|---|---|---|---|
| 101 (Invention) | 80 | 40 | 30° C./40% RH | 0.011 |
| 102 (Invention) | 80 | " | 30° C./50% RH | 0.013 |
| 103 (Comp. Example) | 80 | " | 30° C./60% RH | 0.024 |
| 104 (Invention) | 100 | " | 30° C./40% RH | 0.012 |
| 105 (Invention) | 100 | " | 30° C./50% RH | 0.014 |
| 106 (Comp. Example) | 100 | " | 30° C./60% RH | 0.026 |
| 107 (Comp. Example) | 120 | 25 | 30° C./40% RH | 0.023 |
| 108 (Comp. Example) | 120 | " | 30° C./50% RH | 0.024 |
| 109 (Comp. Example) | 120 | " | 30° C./60% RH | 0.026 |
| 110 (Comp. Example) | 120 | " | 40° C./60% RH | 0.027 |

EXAMPLE 5

The procedure of Example 4 was repeated except that the following silver halide emulsion layer, emulsion-protective layer, backing layer and backing-protective layer were used. The results are shown in Table 5.

(1) Formulation of silver halide emulsion layer

The emulsion A was prepared in the following manner by using the following solutions I, II and III.

Solution I: Water 300 ml, gelatin 9 g

Solution II: $AgNO_3$ 100 g, water 400 ml

Solution III: NaCl 37 g, $(NH_4)_3RhCl_6$ 0.66 mgf, water 400 ml

The solutions II and III were simultaneously added to the solution I kept at 40° C. at a given rate. After soluble salts were removed from the resulting emulsion by a conventional method, gelation was added thereto. Further, 6-methyl-4-hydroxy-1,3,3a,7-tetraazaindene and 4-hydroxy-5,6-trimethylene-1,3,3a,7-tetraazaindene as stabilizers were added thereto. The resulting emulsion was a monodisperse emulsion having a mean grain size of 0.15 μm. The amount of gelation contained therein was 60 g per 1 kg of the yield of the emulsion.

To the thus-obtained emulsion were added the following compounds.

| | |
|---|---|
| 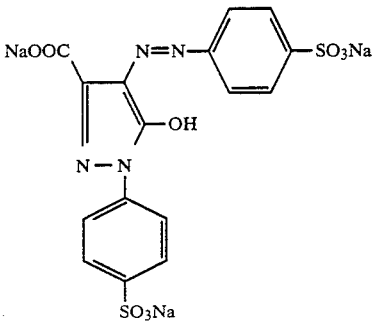 | 5 g/m² |
| Sodium salt of polystyrenesulfonic acid | 10 mg/m² |
| 1,2-Bis(vinylsulfonylacetamidoethane | 100 mg/m² |
| Ethyl acrylate latex (mean grain size: 0.1 μm) | 500 mg/m² |
| 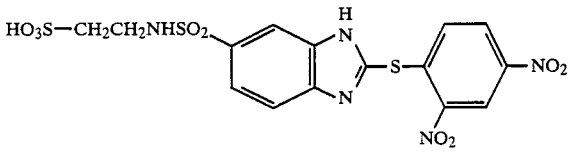 | 0.3 mg/m² |

The thus-obtained coating solution was coated in such an amount as to give a coating weight of 3 g/m² in terms of silver.

Formulation of emulsion-protective layer

| | |
|---|---|
| Gelatin | 1.5 g/m² |
| Fine particle of polymethyl methacrylate (average particle size: 3 μm) | 50 mg/m² |
| 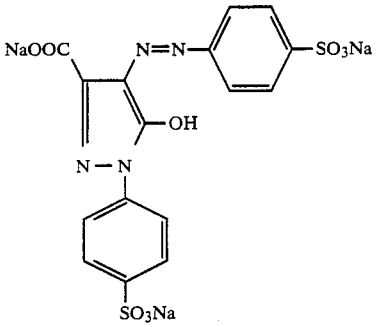 | 5 mg/m² |
| Sodium dodecylbenzenesulfonate | 25 mg/m² |
| Dihexyl sodium α-sulfosuccinate | 10 mg/m² |
| Potassium salt of N-perfluoro octanesulfonyl-N-propylglycine | 2 mg/m² |
| Sodium salt of polystyrenesulfonic acid | 3 mg/m² |
| Ethyl acrylate latex (mean grain size: 0.1 μm) | 200 mg/m² |
| Colloidal silica | 350 mg/m² |
| Lipoic acid | 8 mg/m² |

Formulation of backing layer

| | |
|---|---|
| Gelatin | 2 g/m² |
| 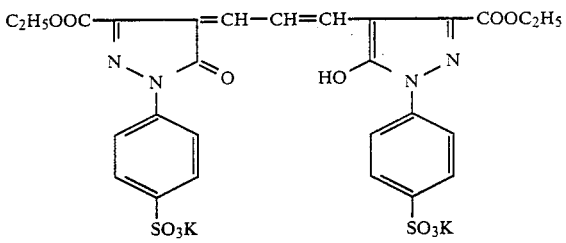 | 30 mg/m² |

-continued

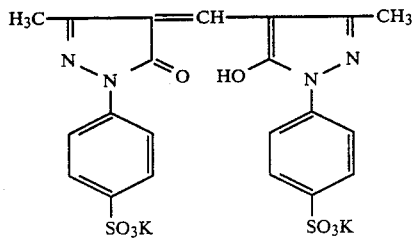

180 mg/m²

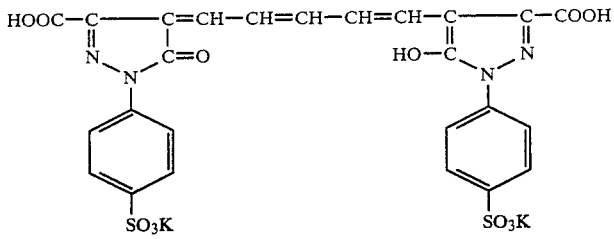

50 mg/m²

| | |
|---|---|
| Dihexyl sodium α-sulfosuccinate | 20 mg/m² |
| Sodium dodecylbenzenesulfonate | 30 mg/m² |
| Sodium salt of polystyrenesulfonic acid | 30 mg/m² |
| 1,3-Divinylsulfonyl-2-propanol | 100 mg/m² |
| Ethyl acrylate latex (mean grain size: 0.1 μm) | 200 mg/m² |

Formulation of back layer

| | |
|---|---|
| Gelatin | 1 g/m² |
| Fine particle of polymethyl methacrylate (average particle size: 3 μm) | 40 mg/m² |
| Dihexyl sodium α-sulfosuccinate | 10 mg/m² |
| Sodium dodecylbenzenesulfonate | 30 mg/m² |
| Sodium salt of polystyrenesulfonic acid | 25 mg/m² |
| Sodium acetate | 30 mg/m² |

Coating, packaging, development and dimension measurement were conducted in the same way as in Example 4.

Table 6. The samples were compared in the same manner as in Example 1. The results are shown in Table 6. It is apparent from Table 6 that the samples of the invention provided good results.

(1) Formulation of silver halide emulsion layer 1

Solution I: Water 300 ml, gelatin 9 g

Solution II: $AgNO_3$ 100 g, water 400 ml

Solution III: NaCl 37 g, $(NH_4)_3RhCl_6$ 1.1 mg, water 400 ml

The solutions II and IIIA were simultaneously added to the solution I kept at 45° C. at a given rate. After soluble salts were removed from the resulting emulsion by conventional method, gelation was added thereto.

TABLE 5

| Sample No. | Drying conditions: Drying time (sec.) | Temperature (water: 300% or more) (°C.) | Temperature & humidity (water: 300% or less) | Ratio of change in dimension (%) |
|---|---|---|---|---|
| 201 (Invention) | 80 | 40 | 30° C./40% RH | 0.010 |
| 202 (Invention) | 80 | " | 30° C./50% RH | 0.013 |
| 203 (Comp. Example) | 80 | " | 30° C./60% RH | 0.023 |
| 204 (Invention) | 100 | " | 30° C./40% RH | 0.011 |
| 205 (Invention) | 100 | " | 30° C./50% RH | 0.013 |
| 206 (Comp. Example) | 100 | " | 30° C./60% RH | 0.025 |
| 207 (Comp. Example) | 120 | 25 | 30° C./40% RH | 0.022 |
| 208 (Comp. Example) | 120 | " | 30° C./50% RH | 0.023 |
| 209 (Comp. Example) | 120 | " | 30° C./60% RH | 0.025 |
| 210 (Comp. Example) | 120 | " | 40° C./60% RH | 0.026 |

EXAMPLE 6

One side of the same support as that of Example was coated with the following silver halide emulsion layers 1 and 2 and protective layers 1 and 2 in this order and dried under conditions given in Table 6. The other side of the support was coated with a backing layer and a protective layer 3 and dried under conditions given in Further, 6-methyl-4-hydroxy-1,3,3a,7-tetraazaindene as a stabilizer were added thereto. The resulting emulsion was a monodisperse emulsion having a mean grain size of 0.20 μm. The amount of gelation contained therein was 60 g per 1 kg of the emulsion.

To the thus-obtained emulsion were added the following compounds.

(Compound 1) $5 \times 10^{-3}$ mol/mol of Ag

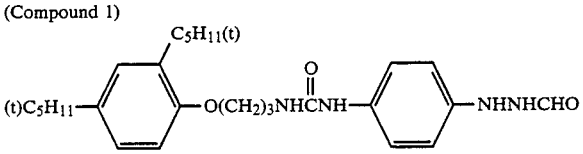

(Compound 2) 120 mg/m$^2$

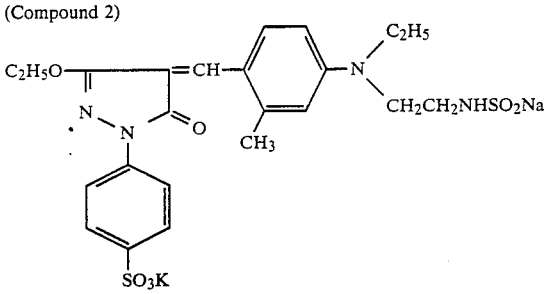

(Compound 3) 100 mg/m$^2$

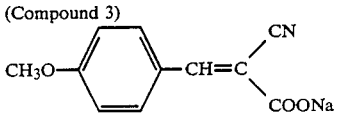

(Compound 4) 100 mg/m$^2$

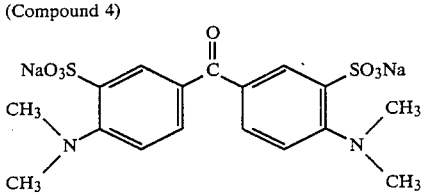

(Compound 5) 9 mg/m$^2$

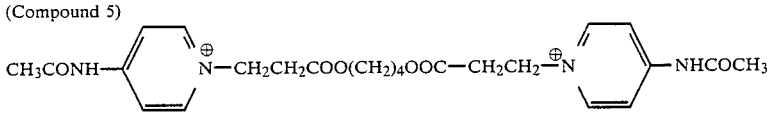

| | |
|---|---|
| Sodium salt of polystyrenesulfonic acid | 30 mg/m$^2$ |
| Sodium salt of N-oleoyl-N-methyltaurine | 50 mg/m$^2$ |
| 1,2-Bis(vinylsulfonylacetamido)ethane | 70 mg/m$^2$ |
| 1-Phenyl-5-mercaptotetrazole | 3 mg/m$^2$ |
| Ethyl acrylate latex (mean grain size: 0.1 μm) | 40 mg/m$^2$ |

(2) Formulation of silver halide emulsion layer 2

Solution I: Water 300 ml, gelatin 9 g

Solution II: $AgNO_3$ 100 g, water 400 ml

Solution III: NaCl 37 g, $(NH_4)_3RhCl_6$ 2.2 mg, water 400 ml

The procedure of the preparation of the emulsion A was repeated except that solution IIIB was used in place of solution IIIA to prepare an emulsion B. The emulsion was a monodisperse emulsion having a mean grain size of 0.20 μm.

| | |
|---|---|
| Compound 1 | $5 \times 10^{-3}$ mol/mol of Ag |
| Compound 2 | 120 mg/m$^2$ |
| Compound 3 | 100 mg/m$^2$ |
| Compound 4 | 100 mg/m$^2$ |
| Compound 5 | 9 mg/m$^2$ |
| Sodium salt of polystyrenesulfonic acid | 50 mg/m$^2$ |
| Sodium salt of N-oleoyl-N-methyl-taurine | 40 mg/m$^2$ |
| 1,2-Bis(vinylsulfonylacetamide)ethane | 85 mg/m$^2$ |
| 1-Phenyl-5-mercaptotetrazole | 3 mg/m$^2$ |
| Ethyl acrylate latex | 40 mg/m$^2$ |

-continued

| | |
|---|---|
| (mean grain size: 0.1 μm) | |

The thus-obtained coating solution was coated in an amount to give a coating weight of 2 g/m$^2$ in terms of silver.

(3) Formulation of protective layer 1

| | |
|---|---|
| Gelatin | 1.0 g/m$^2$ |
| Lipoic acid | 5 mg/m$^2$ |
| Sodium dodecylbenzenesulfonate | 5 mg/m$^2$ |
| Compound 3 | 20 mg/m$^2$ |
| Sulfuric ester sodium salt of poly (degree of polymerization: 5)-oxyethylene nonylphenol ether | 5 mg/m$^2$ |
| Sodium salt of polystyrenesulfonic acid | 10 mg/m$^2$ |

-continued

| | |
|---|---|
| | 20 mg/m$^2$ |

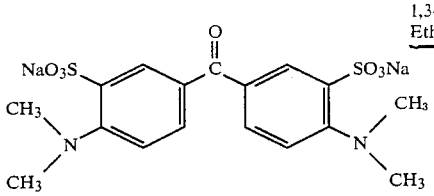

| | |
|---|---|
| Ethyl acrylate latex (mean grain size: 0.1 μm) | 200 mg/m$^2$ |

(4) Formulation of protective layer 2

| | |
|---|---|
| Gelatin | 1.0 g/m$^2$ |
| Fine particle of polymethyl methacrylate (average particle size: 3 μm) | 60 mg/m$^2$ |
| Sodium dodecylbenzenesulfonate | 20 mg/m$^2$ |
| Potassium salt of N-perfluoro-octanesulfonyl-N-propylglycine | 3 mg/m$^2$ |
| Sulfuric ester sodium salt of poly (degree of polymerization: 5)-oxyethylene nonylphenol ether | 15 mg/m$^2$ |
| Sodium salt of polystyrenesulfonic acid | 2 mg/m$^2$ |

-continued (5) Formulation of backing layer

| | |
|---|---|
| Gelatin | 2.5 g/m$^2$ |
| 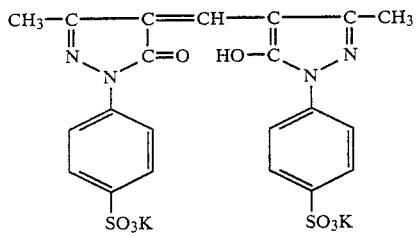 | 300 mg/m$^2$ |
| 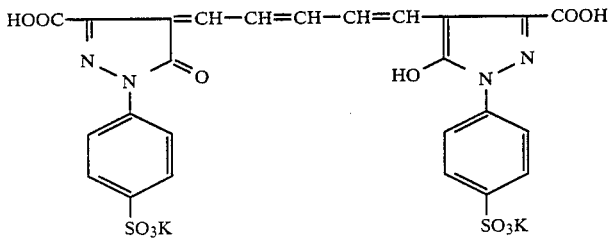 | 50 mg/m$^2$ |
| 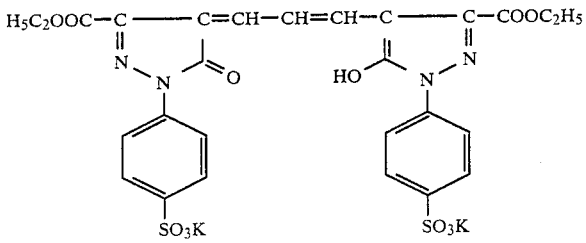 | 50 mg/m$^2$ |
| Sodium dodecylbenzenesulfonate | 50 mg/m$^2$ |
| Dihexyl sodium α-sulfosuccinate | 20 mg/m$^2$ |
| Sodium salt of polystyrenesulfonic acid | 40 mg/m$^2$ |
| 1,3-Divinylsulfonyl-2-propanol | 150 mg/m$^2$ |
| Ethylacrylate latex (mean grain size: 0.1 μm) | 500 mg/m$^2$ |

(6) Formulation of protective layer 3 (protective layer for backing layer)

| | |
|---|---|
| Gelatin | 1.0 g/m$^2$ |
| Fine particle of polymethyl methacrylate (average particle size: 3 μm) | 40 mg/m$^2$ |
| Sodium dodecylbenzenesulfonate | 15 mg/m$^2$ |
| Dihexyl sodium α-sulfosuccinate | 10 mg/m$^2$ |
| Sodium salt of polystyrenesulfonic acid | 20 mg/m$^2$ |
| Sodium acetate | 40 mg/m$^2$ |

(7) In Example 6, coating, packaging and dimension measurement were conducted in the same way as in Example 1.

TABLE 6

| Sample No. | Drying conditions: Drying time (sec.) | Temperature (water: 300% or more) (°C.) | Temperature & humidity (water: 300% or less) | Ratio of change in dimension (%) |
|---|---|---|---|---|
| 301 (Invention) | 80 | 40 | 30° C./40% RH | 0.011 |
| 302 (Invention) | 80 | " | 30° C./50% RH | 0.012 |
| 303 (Comp. Example) | 80 | " | 30° C./60% RH | 0.024 |
| 304 (Invention) | 100 | " | 30° C./40% RH | 0.013 |
| 305 (Invention) | 100 | " | 30° C./50% RH | 0.015 |

TABLE 6-continued

| Sample No. | Drying conditions: Drying time (sec.) | Temperature (water: 300% or more) (°C.) | Temperature & humidity (water: 300% or less) | Ratio of change in dimension (%) |
|---|---|---|---|---|
| 306 (Comp. Example) | 100 | " | 30° C./60% RH | 0.027 |
| 307 (Comp. Example) | 120 | 25 | 30° C./40% RH | 0.024 |
| 308 (Comp. Example) | 120 | " | 30° C./50% RH | 0.025 |
| 309 (Comp. Example) | 120 | " | 30° C./60% RH | 0.028 |
| 310 (Comp. Example) | 120 | " | 40° C./60% RH | 0.029 |

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a polyester film support having thereon at least one hydrophilic colloid layer containing a polymer latex; and between the support and the hydrophilic colloid layer a layer containing a vinylidene chloride copolymer core-shell latex; at least one hydrophilic colloid layer of the material being a light-sensitive silver halide emulsion layer, wherein the core of said core-shell latex comprises a vinylidene chloride copolymer comprising at least one repeating unit represented by formula (I) and at least one repeating unit represented by formula (II); and the shell of said core-shell latex comprises a vinylidene chloride copolymer comprising at least one repeating unit represented by formula (I), at least one repeating unit represented by formula (III) and at least one repeating unit represented by formula (IV):

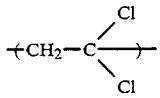
(I)

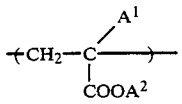
(II)

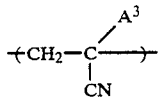
(III)

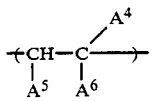
(IV)

wherein $A^1$ represents hydrogen, methyl or a halogen atom; $A^2$ represents a substituted or unsubstituted alkyl group or phenyl group; $A^3$ represents hydrogen or methyl; $A^4$ represents hydrogen, methyl or $—CH_2$-COOM; $A^5$ represents hydrogen, methyl or —COOM; $A^6$ represents —COOM, a COOM-substituted alkoxycarbonyl group, a COOM-substituted phenyl group or a COOM-substituted N-alkylcarbamoyl group; and M represents hydrogen or an alkali metal.

2. The silver halide photographic material as claimed in claim 1, wherein said vinylidene chloride copolymer latex has a vinylidene chloride content of 70.0 to 98.5 wt %.

3. The silver halide photographic material as claimed in claim 2, wherein said vinylidene chloride copolymer latex has a vinylidene chloride content of 85 to 97 wt %.

4. The silver halide photographic material as claimed in claim 3, wherein said vinylidene chloride copolymer latex has a vinylidene chloride content of 88 to 94 wt %.

5. The silver halide photographic material as claimed in claim 1, wherein said vinylidene chloride copolymer comprises at least one comonomer selected from acrylic acid, an acrylic acid salt, an acrylic ester, methacrylic acid, a methacrylic acid salt, a methacrylic ester, crotonic acid, a crotonic acid salt, a crotonic ester, a vinyl ester, maleic acid, a maleic acid salt, a maleic acid diester, fumaric acid, a fumaric acid salt, a fumaric acid diester, itaconic acid, an itaconic acid salt, an itaconic acid diester, an acrylamide, a methacrylamide, a vinyl ether, a styrene, an allyl compound, a vinyl ketone, a heterocyclic vinyl compound and an unsaturated nitrile.

6. The silver halide photographic material as claimed in claim 1, wherein said core-shell latex comprises a core having a vinylidene chloride content of 88 to 97 wt % and a shell having a vinylidene chloride content of 70 to 92 wt %.

7. The silver halide photographic material as claimed in claim 6, wherein the weight ratio of said core to said shell is from 7/3 to 95/5.

8. The silver halide photographic material as claimed in claim 6, wherein said core has a vinylidene chloride content of 88 to 94 wt % and said shell has a vinylidene chloride content of 85 to 92 wt %.

9. The silver halide photographic material as claimed in claim 8, wherein the core-shell weight ratio of said latex is from 60/40 to 95/5.

10. The silver halide photographic material as claimed in claim 9, wherein the core-shell weight ratio of said latex is from 70/30 to 90/10.

11. The silver halide photographic material as claimed in claim 1, wherein said core-shell latex comprises a total of from 70 to 98.5 wt % of said repeating unit represented by formula (I); from 1.0 to 20 wt % of said repeating unit represented by formula (II); from 0.1 to 5.0 wt % of said repeating unit represented by formula (III) and from 0.05 to 3.0 wt % of said repeating unit represented by formula (IV).

12. The silver halide photographic material as claimed in claim 11, wherein said core-shell latex comprises a total of from 85 to 97 wt % of said repeating unit represented by formula (I); from 2 to 12 wt % of said repeating unit represented by formula (II); from 0.3 to 3.5 wt % of said repeating unit represented by formula (III) and from 0.1 to 1.5 wt % of said repeating unit represented by formula (IV).

13. The silver halide photographic material as claimed in claim 12, wherein said core shell latex comprises a total of from 88 to 94 wt % of said repeating unit represented by formula (I); from 5 to 10 wt % of said repeating unit represented by formula (II); from 0.5 to 2.5 wt % of said repeating unit represented by formula (III) and from 0.1 to 0.8 wt % of said repeating unit represented by formula (IV).

14. The silver halide photographic material as claimed in claim 1, wherein $A^1$ represents hydrogen, methyl, Cl or F; $A^2$ represents a substituted or unsubstituted alkyl group containing 1 to 6 carbon atoms; $A^3$ represents hydrogen or methyl; $A^4$ represents hydrogen, methyl or —$CH_2COOH$; $A^5$ represents hydrogen; and $A^6$ represents —COOH, an alkoxycarbonyl group substituted with COOH, or an N-alkylcarbamoyl group substituted with —COOH.

15. The silver halide photographic material as claimed in claim 14, wherein $A^1$ represents hydrogen or methyl; $A^2$ represents an unsubstituted alkyl group containing 1 to 4 carbon atoms; $A^4$ represents hydrogen or methyl; and $A^6$ represents —COOH.

16. The silver halide photographic material as claimed in claim 1, wherein said vinylidene chloride copolymer layer is from 0.3 μm or more.

17. The silver halide photographic material as claimed in claim 1, wherein said polyester film support has a second vinylidene chloride copolymer layer on the surface opposite said vinylidene chloride copolymer layer.

18. The silver halide photographic material as claimed in claim 1, wherein said hydrophilic colloid layer comprises a gelatin binder and a polymer latex having an average particle diameter of 20 to 700 mμ in a latex:gelatin dry weight ratio of from 0.01:1.0 to 1.0:1.0.

* * * * *